US010213641B2

(12) United States Patent
Lagree

(10) Patent No.: US 10,213,641 B2
(45) **Date of Patent: *Feb. 26, 2019**

(54) EXERCISE MACHINE HANDLE SYSTEM

(71) Applicant: Lagree Technologies, Inc., Burbank, CA (US)

(72) Inventor: Sebastien Anthony Louis Lagree, Burbank, CA (US)

(73) Assignee: Lagree Technologies, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/434,027

(22) Filed: Feb. 15, 2017

(65) Prior Publication Data

US 2017/0157458 A1 Jun. 8, 2017

Related U.S. Application Data

(63) Continuation of application No. 14/791,631, filed on Jul. 6, 2015, now abandoned, which is a continuation
(Continued)

(51) Int. Cl.
*A63B 21/00* (2006.01)
*A63B 21/04* (2006.01)
(Continued)

(52) U.S. Cl.
CPC ..... *A63B 22/0089* (2013.01); *A63B 21/0428* (2013.01); *A63B 21/1488* (2013.01);
(Continued)

(58) Field of Classification Search
CPC ..... A63B 21/0428; A63B 22/0087–22/0089; A63B 23/0211; A63B 23/0233; A63B 2208/0252; A63B 21/4035; A63B 23/1236
See application file for complete search history.

(56) References Cited

U.S. PATENT DOCUMENTS 1,866,868 A 7/1932 Thomson
2,223,309 A 11/1940 Swanson
(Continued)

FOREIGN PATENT DOCUMENTS

AU 2004200589 A1 3/2004
DE 198 32 235 A1 1/2000

OTHER PUBLICATIONS

Pictures of MEGAFORMER M2 Exercise Machine; Jan. 1, 2011.
(Continued)

*Primary Examiner* — Jennifer M Deichl
(74) *Attorney, Agent, or Firm* — Neustel Law Offices

(57) ABSTRACT

An exercise machine carriage system which allows for a wide range of exercises while maintaining improved balance and control for the exerciser. The exercise machine generally includes a stationary frame and a carriage adapted to slide along at least one track on the frame. The carriage may include at least one opening on its upper surface to be used by an exerciser to perform a variety of exercises. The carriage may also include, either in combination with the openings or alternatively, at least one carriage strap extending across its upper surface for use in a variety of exercises. Platforms may also be included on either end of the frame, each of the platforms including its own platform strap. By utilizing such openings and/or straps, a wide variety of exercises may be accomplished that otherwise would be difficult or impossible to perform on conventional exercise machines.

16 Claims, 23 Drawing Sheets

Related U.S. Application Data of application No. 14/511,527, filed on Oct. 10, 2014, now Pat. No. 9,072,931.

(60) Provisional application No. 61/894,521, filed on Oct. 23, 2013.

(51) Int. Cl.
*A63B 22/00* (2006.01)
*A63B 23/02* (2006.01)
*A63B 23/04* (2006.01)

(52) U.S. Cl.
CPC .... *A63B 21/4045* (2015.10); *A63B 21/00065* (2013.01); *A63B 23/0216* (2013.01); *A63B 23/0405* (2013.01); *A63B 23/0488* (2013.01); *A63B 2208/0204* (2013.01); *A63B 2208/0219* (2013.01); *A63B 2208/0238* (2013.01)

(56) References Cited

U.S. PATENT DOCUMENTS 2,733,922 A 2/1956 Ramon Gonzalez
3,770,267 A 11/1973 McCarthy
3,795,396 A 3/1974 Kropelnitski
3,892,404 A 7/1975 Martucci
4,231,375 A 11/1980 Boehringer
4,706,953 A 11/1987 Graham
4,709,920 A 12/1987 Schnell
4,845,987 A 7/1989 Kenneth
5,110,122 A 5/1992 Moore
5,139,471 A 8/1992 Dornberger
5,179,746 A 1/1993 Rogers
5,211,617 A 5/1993 Millen
5,374,226 A 12/1994 Grahm
5,380,259 A 1/1995 Robertson
5,653,670 A 8/1997 Endelman
5,681,249 A 10/1997 Endelman
5,792,033 A 8/1998 Merrithew
5,830,115 A 11/1998 Chen
5,857,946 A 1/1999 Brown
5,906,564 A 5/1999 Jacobsen
5,935,049 A 8/1999 Hamm
5,961,430 A 10/1999 Zuckerman
6,042,523 A * 3/2000 Graham ..... A63B 21/0552 482/121
6,120,425 A 9/2000 Endelman
6,315,695 B1 11/2001 Follett
6,338,704 B1 1/2002 Endelman
6,461,283 B1 10/2002 Maron
6,471,624 B1 10/2002 Voris
6,527,685 B2 3/2003 Endelman
6,595,902 B1 7/2003 Savage
6,651,281 B1 11/2003 Figiel
6,652,425 B1 11/2003 Martin
6,726,608 B1 4/2004 Hsu
6,805,409 B2 10/2004 Parker
6,971,976 B2 12/2005 Endelman
7,029,425 B2 4/2006 Krull
7,104,933 B1 9/2006 Liao
7,163,498 B1 1/2007 Abelbeck
7,163,500 B2 1/2007 Endelman
7,384,381 B2 6/2008 Webber
7,674,211 B2 3/2010 Uygan
7,682,297 B2 3/2010 Graham
7,803,095 B1 9/2010 LaGree
7,819,777 B1 10/2010 Service
7,942,799 B1 5/2011 Boyd
8,613,692 B2 * 12/2013 Baudhuin ..... A63B 21/00072 297/239
8,641,585 B2 2/2014 LaGree
2003/0119635 A1 6/2003 Arbuckle
2006/0252613 A1 11/2006 Barnes
2009/0048078 A1 2/2009 Marcantonio
2009/0108648 A1 4/2009 Biggs
2009/0118108 A1 * 5/2009 Uygan ..... A63B 21/154 482/135
2011/0152032 A1 6/2011 Barnett
2011/0172069 A1 * 7/2011 Gerschefske ..... A63B 22/0089 482/139
2013/0017935 A1 1/2013 Endelman
2014/0121079 A1 5/2014 Lagree
2014/0141948 A1 * 5/2014 Aronson ..... A63B 21/023 482/128

OTHER PUBLICATIONS https://web.archive.org/web/20100501142110/http:/spxfitness.com/index.php?option=com_content&view=article&id=32&Itemid=3; May 1, 2010 SPX Fitness Superformer Webpage Screenshot.
Picture of a product developed by the inventor, Sebastien Lagree, in 2007.
Pictures of Megaformer product developed by the inventor, Sebastien Lagree, Printed and Received Feb. 4, 2011.
Picture of PROFORMER Exercise Machine; Dec. 31, 2008.
Picture of MEGAFORMER M2 Exercise Machine; Jan. 1, 2011.

* cited by examiner

EXERCISE MACHINE HANDLE SYSTEM

CROSS REFERENCE TO RELATED APPLICATIONS

The present application is a continuation of U.S. application Ser. No. 14/791,631 filed on Jul. 6, 2015, which is a continuation of U.S. application Ser. No. 14/511,527 filed on Oct. 10, 2014 now issued as U.S. Pat. No. 9,072,931, which claims priority to U.S. Provisional Application No. 61/894,521 filed Oct. 23, 2013.

The present application is also a continuation-in-part of U.S. application Ser. No. 14/065,851 filed on Oct. 29, 2013, which is a continuation-in-part of U.S. application Ser. No. 13/068,795 filed on May 20, 2011 now issued as U.S. Pat. No. 8,641,585 and a continuation-in-part of U.S. application Ser. No. 13/924,088 filed on Jun. 21, 2013 now issued as U.S. Pat. No. 9,119,989, which claims priority to U.S. Provisional Application No. 61/719,757 filed on Oct. 29, 2012. U.S. application Ser. No. 14/065,851 claims priority to U.S. Provisional Application No. 61/806,655 filed Mar. 29, 2013 and U.S. Provisional Application No. 61/719,763 filed Oct. 29, 2012.

Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to an exercise machine carriage and more specifically it relates to an exercise machine carriage which allows for a wide range of exercises while maintaining improved balance and control for the exerciser.

Description of the Related Art

Any discussion of the related art throughout the specification should in no way be considered as an admission that such related art is widely known or forms part of common general knowledge in the field.

Exercise machines have been in use for many years. One common exercise machine that has enjoyed increasing popularity is the Pilates machine. A conventional Pilates machine generally includes a frame, a track extending across the frame, and a carriage slidably connected to the track. The carriage is connected to one end of the frame by one or more bias members such as springs. U.S. Pat. Nos. 7,803,095 and 8,641,585 to Sebastien Lagree both disclose an exemplary exercise machines suitable for Pilates exercises and additional exercises. U.S. Pat. No. 8,641,585 discloses the usage of a pair of openings at one end of the carriage.

While there have been numerous improvements in Pilates machines over the years, resulting in a wide variety of new designs, the prior art designs still suffer from a number of drawbacks. Because prior art Pilates machines do not include openings on either end of the carriage, or the use of straps, an exerciser is forced to rely upon frictional engagement between the body and the carriage when moving the carriage back and forth along the track during exercise.

This severely limits the types of exercises that can be performed to exercises which can be performed with simply a frictional engagement between the body and the carriage.

Exercises in which there is limited contact between the body and the carriage, such as an exercise performed with fingertips or toes, are difficult or impossible to perform without something to anchor the fingertips, toes, or other limited contact body parts to the carriage. Even with more conventional exercises, the lack of such anchoring points as straps or openings increases the risk that a body part will slip off the carriage during exercise and result in injury.

Because of the inherent problems with the related art, there is a need for a new and improved exercise machine carriage system which allows for a wide range of exercises while maintaining improved balance and control for the exerciser.

BRIEF SUMMARY OF THE INVENTION

The invention generally relates to an exercise machine carriage system which includes a stationary frame and a carriage adapted to slide along at least one track on the frame. The carriage may include at least one opening on its upper surface to be used by an exerciser to perform a variety of exercises. The carriage may also include, either in combination with the openings or alternatively, at least one carriage strap extending across its upper surface for use in a variety of exercises. Platforms may also be included on either end of the frame, each of the platforms including its own platform strap. By utilizing such openings and/or straps, a wide variety of exercises may be accomplished that otherwise would be difficult or impossible to perform on conventional exercise machines.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining one or more embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
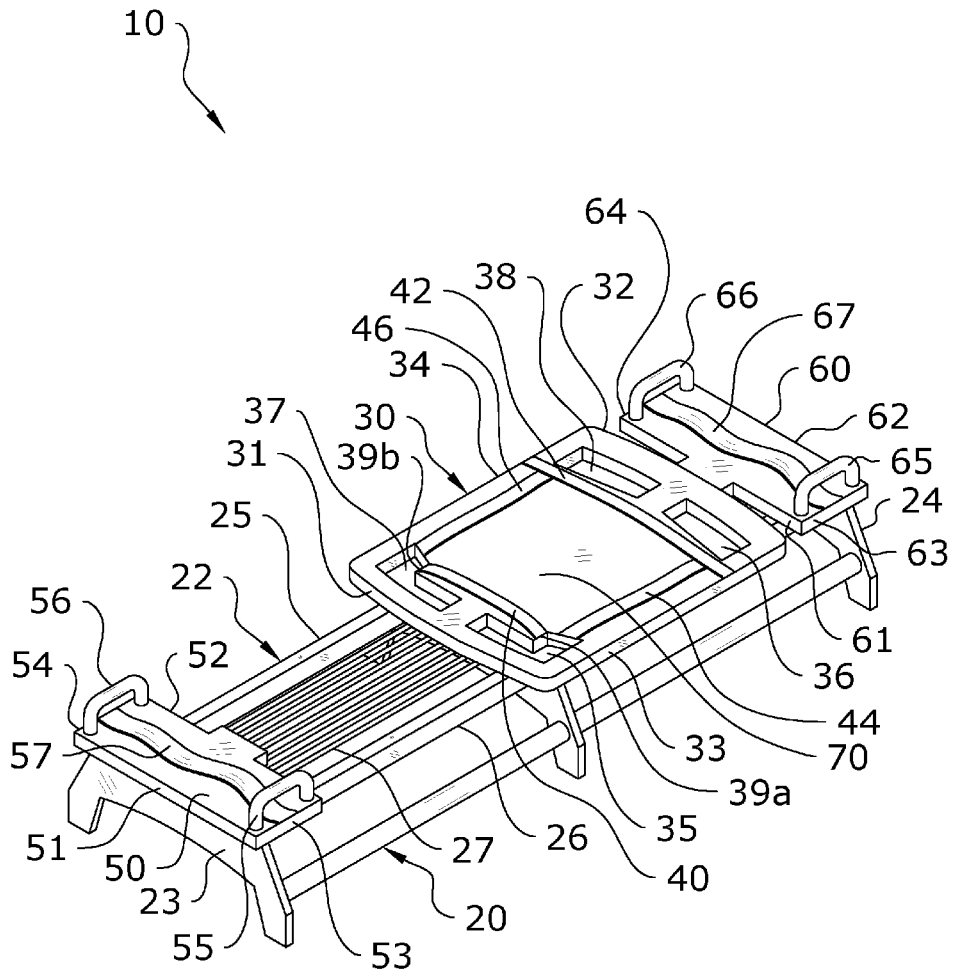
FIG. 1 is an upper perspective view of the present invention.
Figure 2:
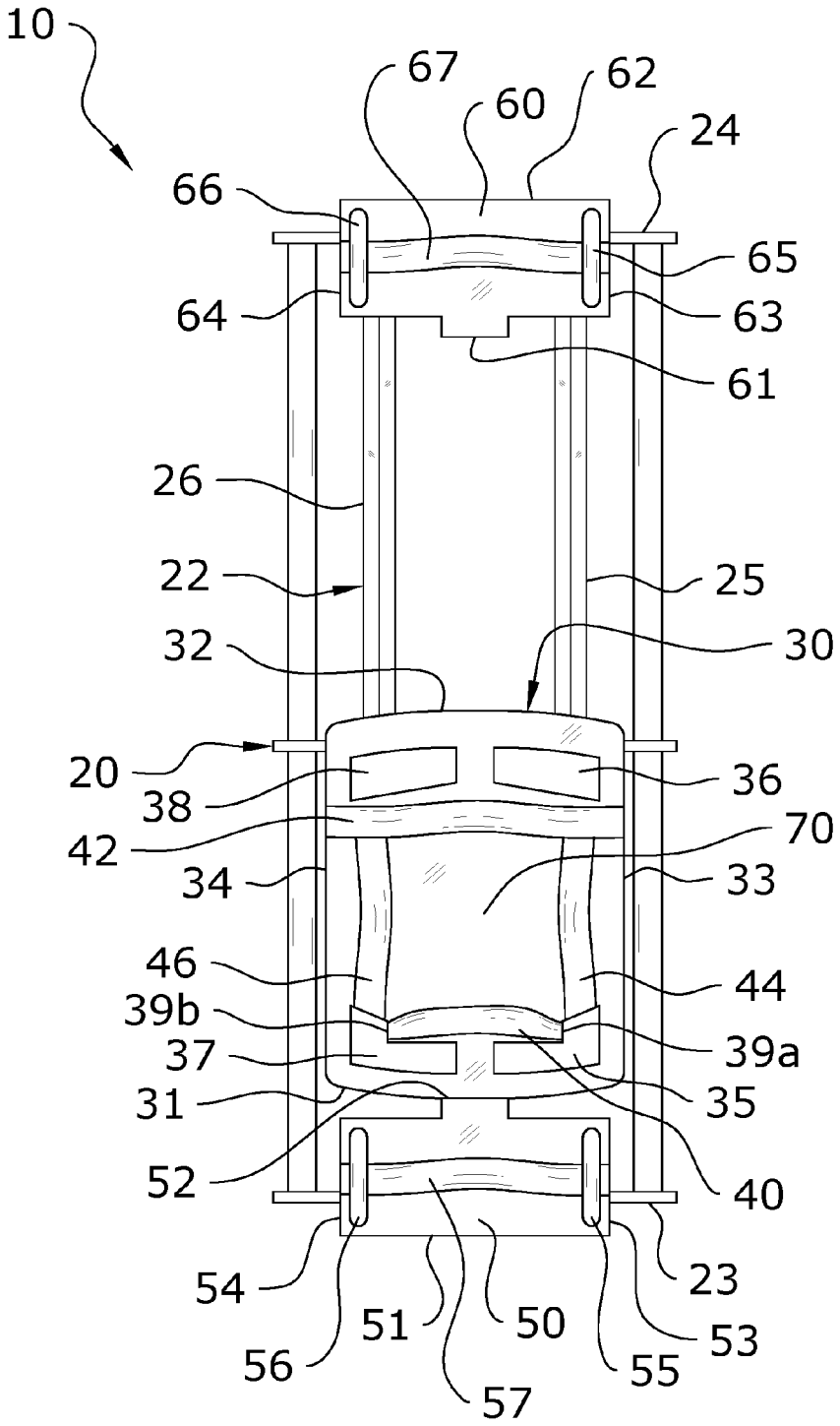
FIG. 2 is a top view of the present invention.
Figure 3:
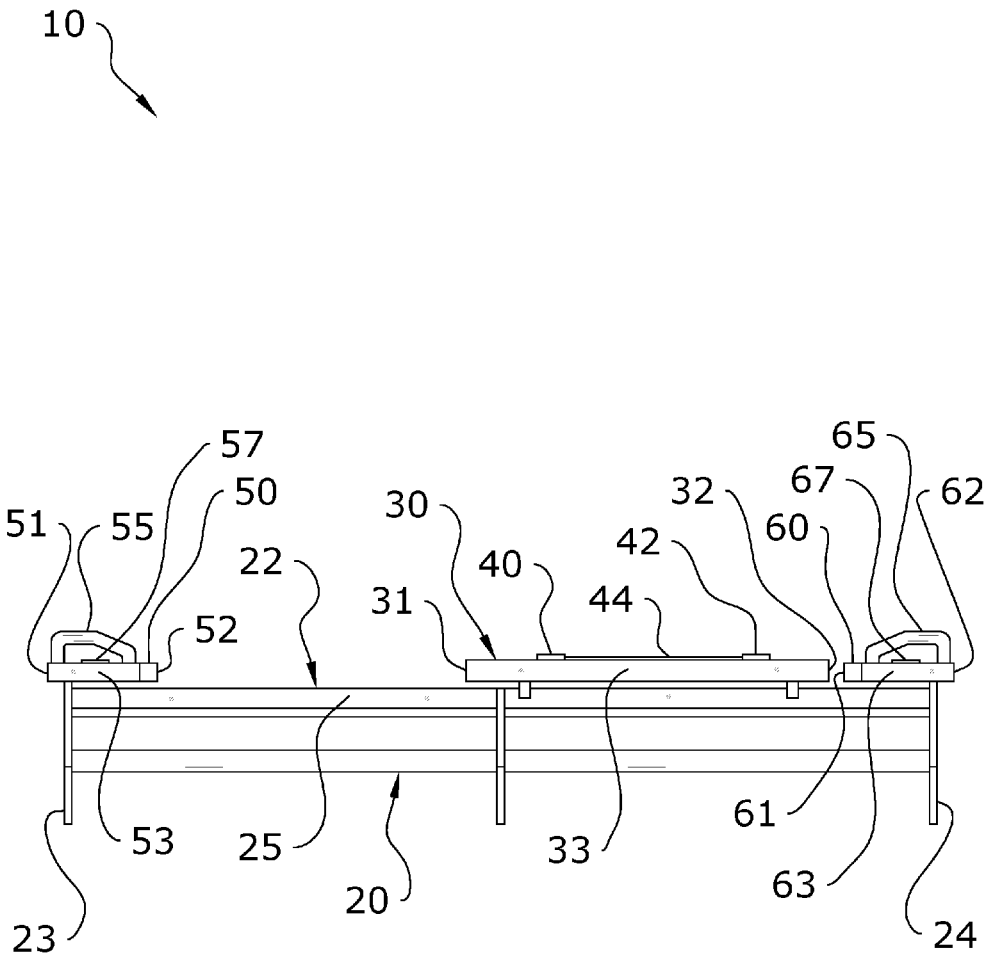
FIG. 3 is a side view of the present invention.

Turning now descriptively to the drawings, in which similar reference characters denote similar elements throughout the several views, FIGS. 1 through 12 illustrate an exercise machine carriage system 10, which comprises an exercise machine 20 which includes a stationary frame 22 and a carriage 30 adapted to slide along at least one track 25, 26 on the frame 22. The carriage 30 may include at least one opening 35, 36, 37, 38 on its upper surface to be used by an exerciser 12 to perform a variety of exercises. The carriage 30 may also include, either in combination with the openings 35, 36, 37, 38 or alternatively, at least one carriage strap 40, 42, 44, 46 extending across its upper surface for use in a variety of exercises. Platforms 50, 60 may also be included on either end 23, 24 of the frame 22, each of the platforms 50, 60 including its own platform strap 57, 67. By utilizing such openings 35, 36, 37, 38 and/or straps 40, 42, 44, 46, 57, 67, a wide variety of exercises may be accomplished that otherwise would be difficult or impossible to perform on conventional exercise machines.

B. Exercise Machine

The figures illustrate an exemplary exercise machine 20 for use with the present invention. In particular, the present invention is preferably utilized within a Pilates exercise machine 20 as illustrated throughout the figures. While the figures and description illustrate and describe the exercise machine 20 as being comprised of a Pilates machine, it is appreciated that the present invention may be utilized in combination with other exercise machines which includes a carriage 30, one or more end platforms 50, 60, or other structures which would benefit from the usage of openings or straps.

It should be further noted that while certain features and accessories of an exercise machine 20 are shown in the drawings, these references are for illustrative purposes only, and are not meant to be limiting. By virtue of the design fundamentals of exercise machines 20, and because a progressive resistance means is incorporated into the exercise machine 20 as a primary force against which exercises are performed, any number of known or unknown accessories could be added to the apparatuses with the same effect as the accessories and features shown.

As shown throughout the figures, an exemplary exercise machine 20 includes a frame 22 having a first end 23 and a second end 24. The exercise machine 20 includes at least one track 25, 26 extending between the first and second ends 23, 24 on which a carriage 30 slidably moves. In a preferred embodiment shown in the figures, a first track 25 and a second track 26 each extend between the first and second ends 23, 24 of the frame 22 in a parallel manner with respect to each other.

A carriage 30 is movably secured to the tracks 25, 26 such that the carriage 30 may be slid, rolled, or otherwise moved between the first end 23 and the second end 24 of the frame 22. The carriage 30 includes a central axis which extends parallel with respect to the at least one track 25, 26.

The tracks 25, 26 are oriented longitudinally along the moving axis of the exercise machine 20. In some embodiments, the first end 23 of the frame 22 may include a first platform 50 and the second end 24 of the frame 22 may include a second platform 60, with the tracks 25, 26 extending between the platforms 50, 60 as shown in FIG. 1.

In the exemplary figures, one or more bias members 27 are shown being connected between the frame 22 and the carriage 30. The bias members 27 are included to impart a biasing force against which the carriage 30 is moved during exercise. For some exercises, no bias members 27 may be engaged, and for other exercises, one, or a plurality of bias members 27 may be engaged to create the preferred resistance force. Varying K factors may be used for the bias members 27 to create a higher or lower resistive force that would be overcome by an exerciser 12 during exercise. In its resting state, the carriage 30 is positioned substantially closer to the first end 22 of the exercise machine 20.

U.S. Pat. Nos. 7,803,095 and 8,641,585 to Sebastien Lagree both disclose exemplary exercise machines with a movable carriage and are both hereby incorporated herein by reference.

C. Carriage

As shown throughout the figures, the present invention includes a carriage 30 which is movably connected to the one or more tracks 25, 26 of the present invention. In a preferred embodiment, the carriage 30 is movably (e.g. slidably, rollably, etc.) positioned upon one or more tracks 25, 26, with a bias member 27 being connected between the carriage 30 and a frame 22 as shown in FIG. 1. The carriage 30 is movable along a longitudinal axis of the frame 22 of the exercise machine 20 to move between opposing ends of the exercise machine 20.

The carriage 30 may comprise various shapes, sizes, orientations, and configurations. Thus, the scope of the present invention should not be construed as limiting in any of these respects of the carriage 30. In the exemplary embodiment shown in the figures, the carriage 30 includes a first end 31, a second end 32, a first side 33, and a second side 34. Although the carriage 30 is illustrated as having a substantially rectangular configuration, other configurations may be utilized to suit different exercises or body types.

The carriage 30 includes an upper surface 70 that the person exercising engages with their body parts (e.g. feet, hands, arms, legs). The upper surface 70 of the carriage 30 is preferably cushioned and comprised of a relatively non-slip material. The carriage 30 further includes a lower surface 72 that is opposite of the upper surface 70. The moving components that allow the carriage 30 to move along the tracks 25, 26 are attached to the lower surface 72 of the carriage 30. The lower surface 72 and the upper surface 70 are both preferably substantially planar and parallel with respect to one another.

As shown throughout the figures, the carriage 30 may include at least one opening 35, 36, 37, 38 and/or at least one carriage strap 40, 42, 44, 46. Some embodiments of the carriage 30 may include only openings 35, 36, 37, 38, some embodiment of the carriage 30 may include only carriage straps 40, 42, 44, 46, and some embodiments of the carriage 30 may include a combination of openings 35, 36, 37, 38 and carriage straps 40, 42, 44, 46.

Figure 4:
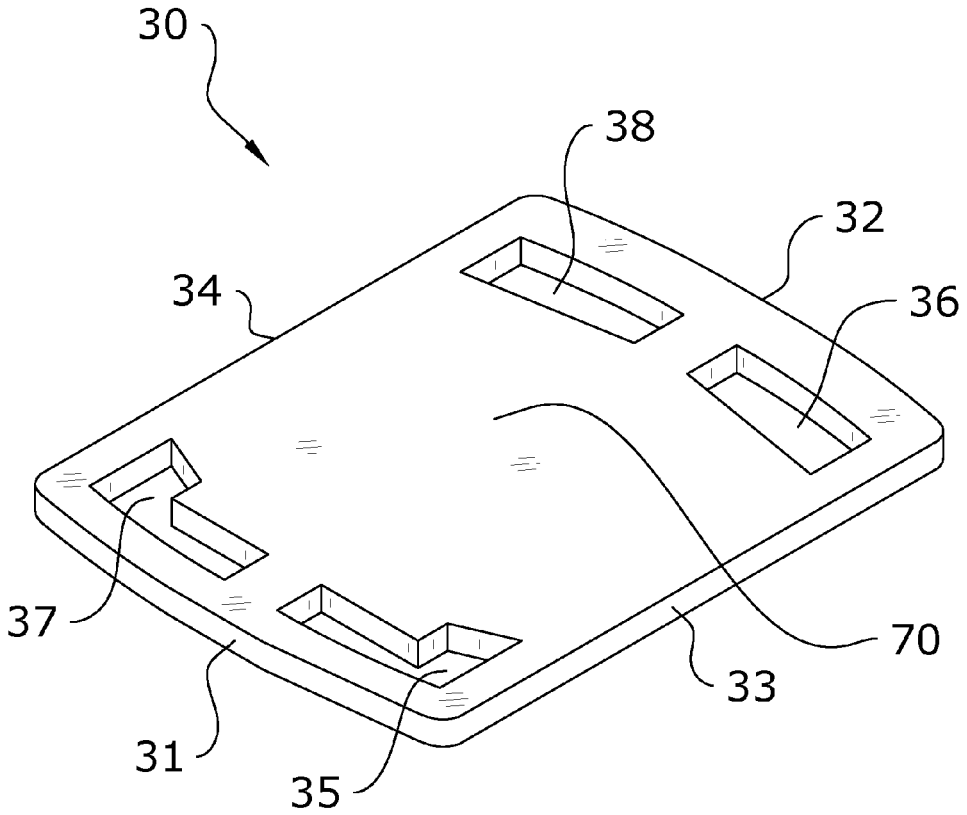
FIG. 4 is an upper perspective view of a carriage of the present invention with openings.

Exemplary embodiments of the carriage 30 are shown throughout the figures. FIG. 4 illustrates a carriage 30 embodiment utilizing only openings 35, 36, 37, 38 and no carriage straps 40, 42, 44, 46. FIGS. 5*a* through 5*f* illustrate an embodiment of the carriage 30 utilizing only carriage straps 40, 42, 44, 46 with no openings 35, 36, 37, 38. FIGS. 6*a* through 6*g* illustrate an embodiment of the carriage 30 which utilizes both openings 35, 36, 37, 38 and carriage straps 40, 42, 44, 46.

i. Carriage Openings.

As shown in FIGS. 1, 2, 4, and 6-9, the carriage 30 may include one or more openings 35, 36, 37, 38 that extend through the upper surface 70 into the body of the carriage 30. The openings 35, 36, 37, 38 preferably extend completely through the carriage 30 from the upper surface 70 to the lower surface 72. However, the openings 35, 36, 37, 38 may only extend partially through the carriage 30 having a terminating end such as a floor.

The openings 35, 36, 37, 38 are adapted for use by the exerciser 12 to insert hands, feet, or other body parts into the openings 35, 36, 37, 38 within the carriage 30 when the present invention is in use. The figures illustrate an exemplary embodiment which includes a first opening 35 near a first end 31 of the carriage 30, a second opening 36 near a second end 32 of the carriage 30, a third opening 37 near the first end 31 of the carriage 30, and a fourth opening 38 near the second end 32 of the carriage 30.

It should be appreciated that the number, shape, size, placement, orientation, and configuration of the openings 35, 36, 37, 38 may vary in different embodiments of the present invention. The figures merely illustrate one exemplary embodiment of the present invention. More or less openings 35, 36, 37, 38 could be included to accommodate more exercises or to target more specific exercises. The shape and size of the openings 35, 36, 37, 38 may vary to accommodate different types of exercisers 12 or to increase or decrease range of movement. The placement and orientation of the openings 35, 36, 37, 38 may be varied for different body types and exercises.

In some embodiments, the openings 35, 36, 37, 38 do not extend fully through the body of the carriage 30 as shown in the figures. In such embodiments, the openings 35, 36, 37, 38 may simple comprise pockets or depressions in the body of the carriage 30 into which the exerciser 12 may place his feet or hands. Some embodiments may include some openings 35, 36, 37, 38 extending fully through the carriage 30 and some openings 35, 36, 37, 38 comprises such pockets or depressions.

In the preferred embodiment shown in the figures, each of the openings 35, 36, 37, 38 comprises an elongated-shaped opening which is substantially transverse with respect to the tracks 25, 26 of the frame 22. It should be appreciated that all of the openings 35, 36, 37, 38 need not be the same shape or size on the same carriage 30. In the figures, the first and third openings 35, 37 each comprise less area than the second and fourth openings 36, 38, with the first and third openings 35, 37 each including inner anchoring edges 39*a,b* to which the first carriage strap 40 may be anchored on either end.

In the figures, the openings 35, 36, 37, 38 are shown in the four corners of the carriage 30. In such an embodiment, the first opening 35 is positioned near the first end 31 of the carriage 30 on a first side of a central axis extending through the body of the carriage 30 parallel with respect to the tracks 25, 26. The first opening 35 is thus preferably positioned near the first side 33 of the carriage 30.

The second opening 36 is positioned near the second end 32 of the carriage 30 on the first side of the same central axis, near the first side 33 of the carriage 30. The third opening 37 is positioned near the first end 31 of the carriage 30 on a second side of the central axis, near the second side 34 of the carriage 30. The fourth opening 38 is positioned near the second end 32 of the carriage 30 on the second side of the central axis, near the second side 34 of the carriage 30.

ii. Carriage Straps.

As shown in FIGS. 1-3 and 5-12, the carriage 30 may include at least one carriage strap 40, 42, 44, 46 lying atop the surface of the carriage 30. Although details are not shown, it should be noted that the carriage straps 40, 42, 44, 46 are affixed to the carriage 30. Nevertheless, the carriage straps 40, 42, 44, 46 are flexible and not overly taught, thereby allowing a exerciser 12 to insert one or more feet or hands between one or more of the carriage straps 40, 42, 44, 46 and the corresponding underlying surface. By inserting feet or hands underneath the carriage straps 40, 42, 44, 46 until all slack is removed and a solid mechanical engagement is realized, the exerciser 12 can more efficiently slide the carriage 30 along the parallel tracks 25, 26 against the spring 27 resistance force, while at the same time, anchor their feet or hands to the platforms 50, 60 for better balance and safer performance of the exercise.

It should be noted that, as shown throughout the figures, the carriage straps 40, 42, 44, 46 may be incorporated into the carriage 30 without the addition of openings 35, 36, 37, 38, and that openings 35, 36, 37, 38 may be incorporated into a carriage 30 without incorporating straps 40, 42, 44, 46. Further, a plurality of straps 40, 42, 44, 46 and openings 35, 36, 37, 38 may be incorporated into the carriage 30 in various ratios or combinations, noting in particular that the straps 40, 42, 44, 46 and openings 35, 36, 37, 38 may be oriented either in alignment with the longitudinal axis of the apparatus, or at any angular orientation to the longitudinal axis such that the straps 40, 42, 44, 46 and openings 35, 36, 37, 38 are oriented to comfortably accommodate feet or hands within the exerciser's 12 normal ranges of motion as necessary to perform various exercises.

In the figures, the at least one carriage strap 40, 42, 44, 46 is shown resting upon the upper surface 70 of the carriage 30. The ends of the carriage straps 40, 42, 44, 46 are affixed to the carriage 30 in such a manner as to allow the exerciser 12 to insert a foot or hand between the carriage straps 40, 42, 44, 46 and carriage 30 surface, thereby securing the hand or foot in a position that prevents the hand or foot from sliding along the carriage 30 during exercise.

The figures show the strap 40, 42, 44, 46 ends projecting through the openings 35, 36, 37, 38, however, the ends of the carriage straps 40, 42, 44, 46 may also wrap around the sides and underneath the carriage 30 surface. In either case, the strap 40, 42, 44, 46 ends are affixed to the carriage 30 using any number of well-known methods including but not limited to mechanical fasteners, hook and loop fasteners, buckles or adhesives. The straps 40, 42, 44, 46 may be fixedly or removably secured to the carriage 30. The positioning of the straps 40, 42, 44, 46 and the method of affixing the straps 40, 42, 44, 46 to the carriage 30 are not meant to be limiting.

Figure 5A:
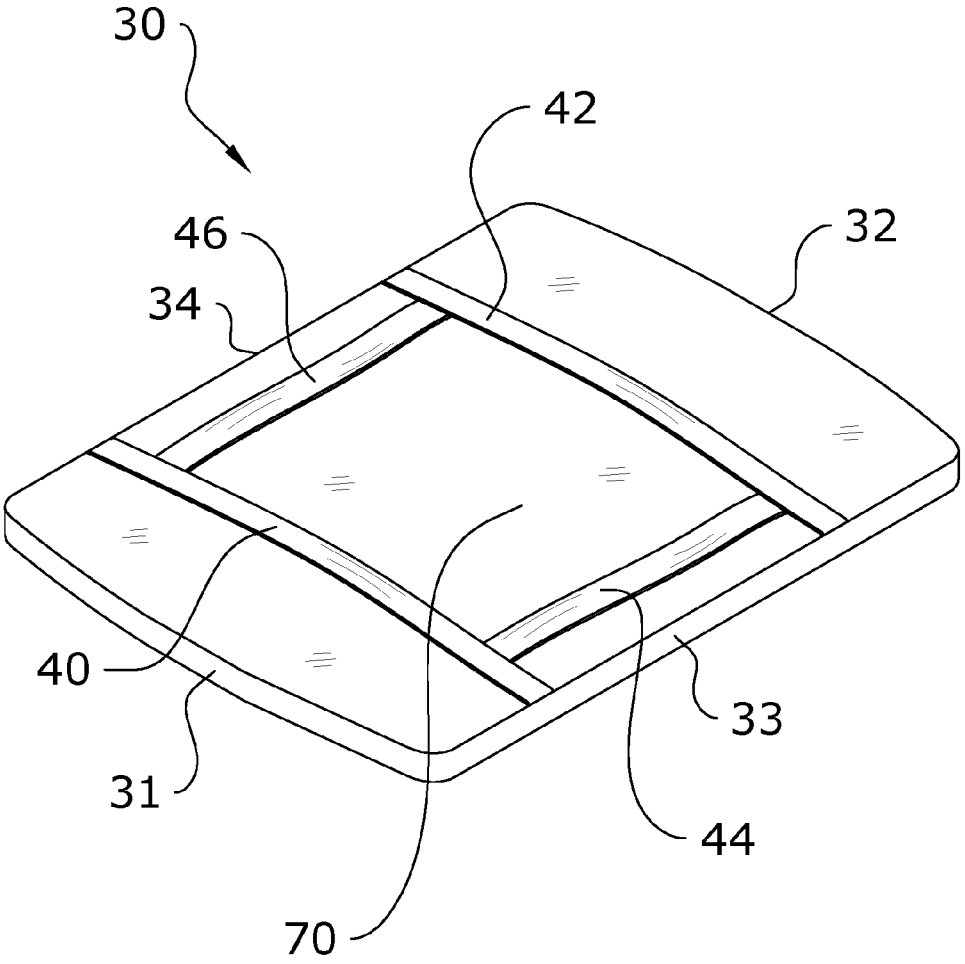
FIG. 5*a* is an upper perspective view of a carriage of the present invention with straps.
Figure 5B:
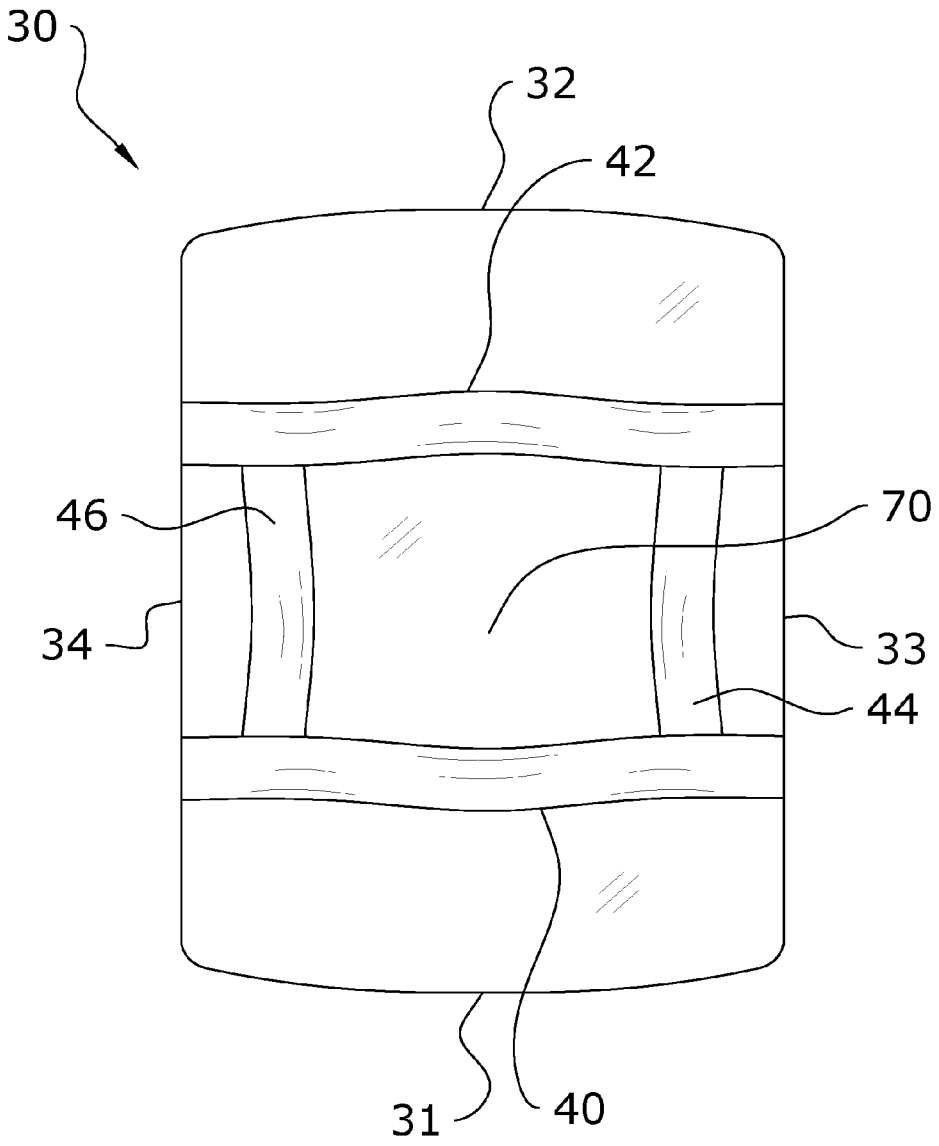
FIG. 5*b* is a top view of the carriage having no openings with straps at opposing ends and opposing sides.
Figure 5C:
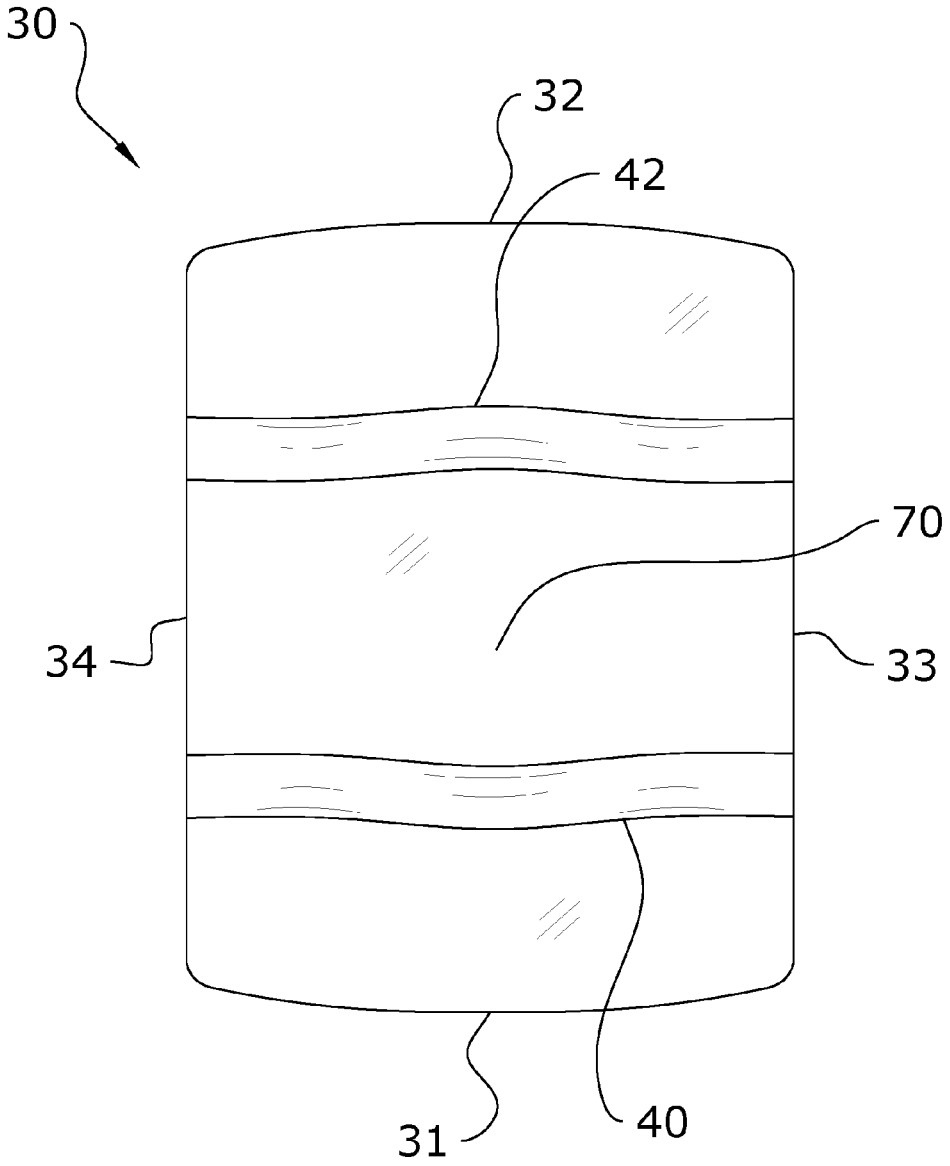
FIG. 5*c* is a top view of the carriage with straps at opposing ends.
Figure 5D:
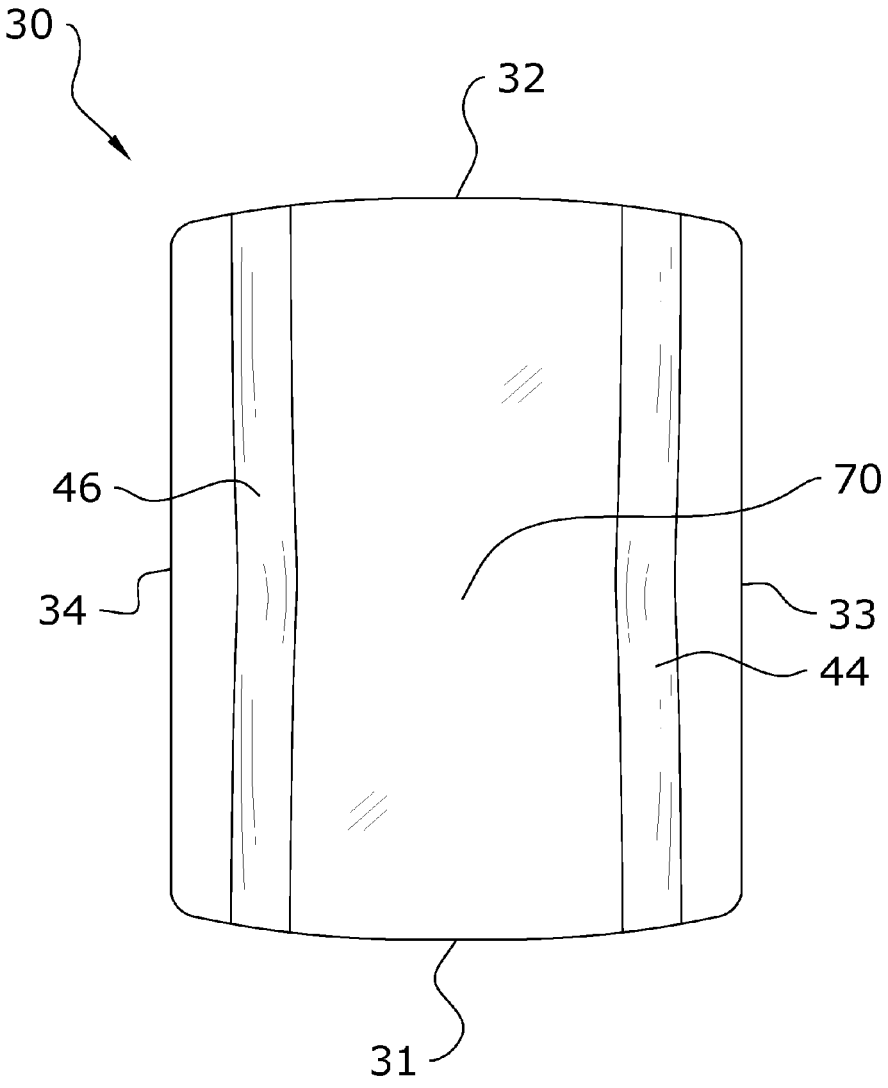
FIG. 5*d* is a top view of the carriage with straps at opposing sides.
Figure 5E:
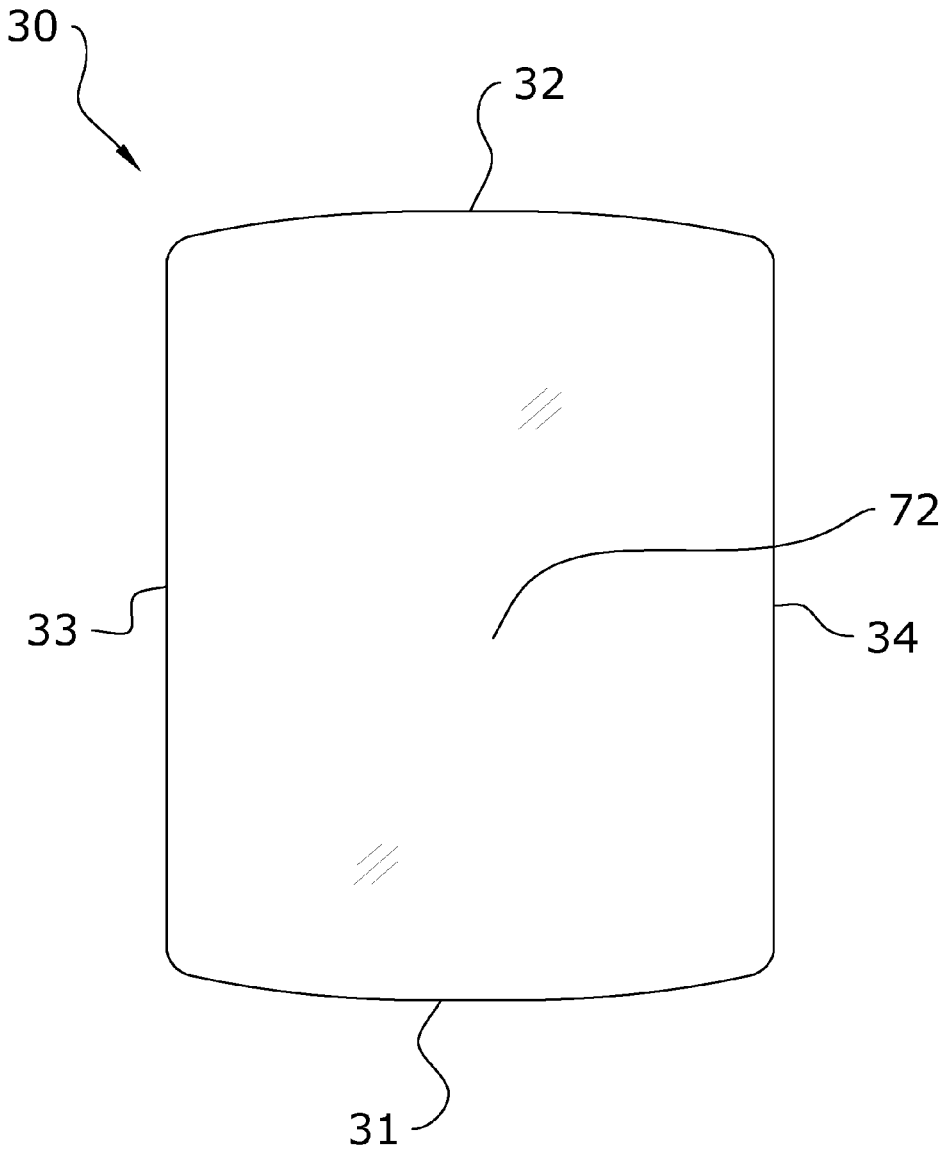
FIG. 5*e* is a bottom view of the carriage.
Figure 5F:
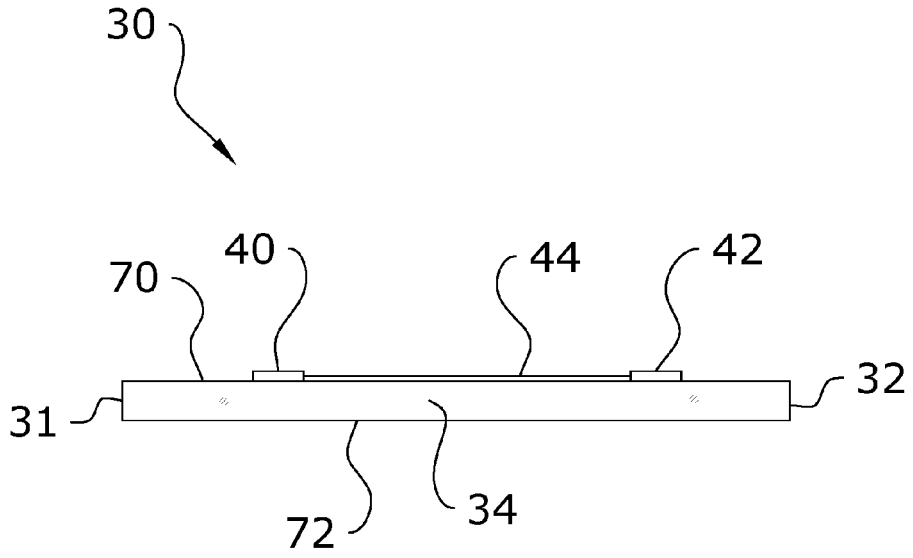
FIG. 5*f* is a side view of the carriage.

The figures illustrate a preferred embodiment which includes four carriage straps 40, 42, 44, 46. In such an embodiment as best shown in FIG. 5*a*, a first carriage strap 40 extends across an upper surface of the carriage 30 near its first end 31 transversely (e.g. perpendicularly) with respect to the tracks 25, 26. A second carriage strap 42 extends across an upper surface of the carriage 30 near its second end 32 perpendicularly with respect to the tracks 25, 26. A third carriage strap 44 extends across an upper surface of the carriage 30 near its first side 33 parallel with respect to the tracks 25, 26. A fourth carriage strap 46 extends across an upper surface of the carriage 30 near its second side 34 parallel with respect to the tracks 25, 26.

Figure 6A:
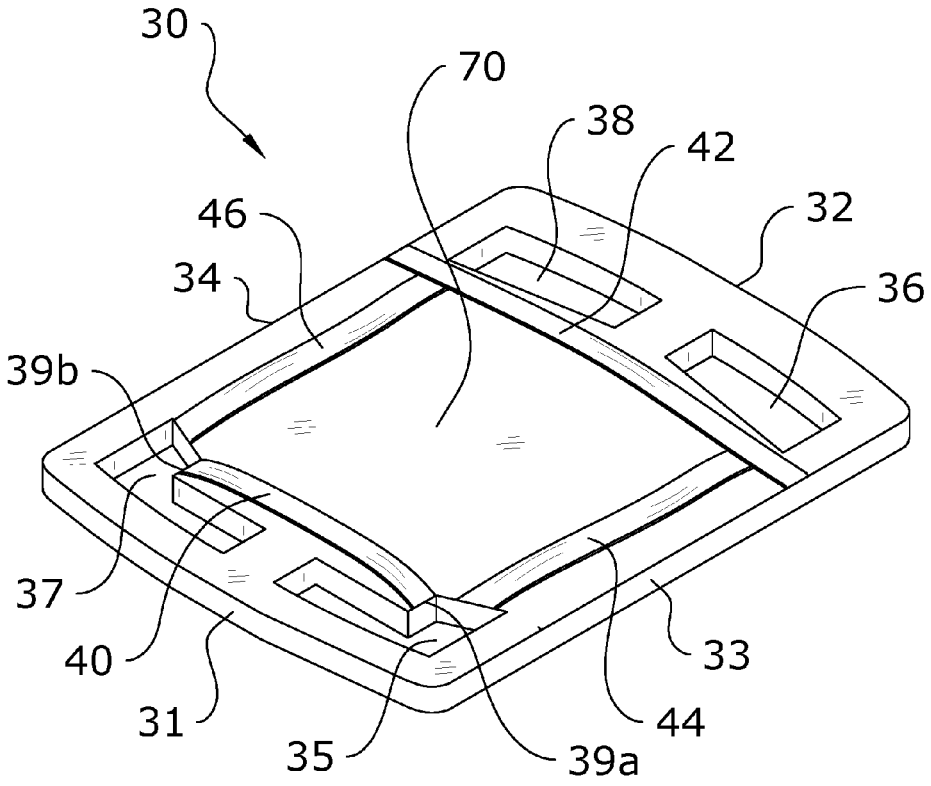
FIG. 6*a* is an upper perspective view of a carriage of the present invention with straps and openings.

FIG. 6*a* illustrates a carriage 30 embodiment which incorporates both openings 35, 36, 37, 38 and carriage straps 40, 42, 44, 46. The orientation and positioning of the carriage straps 40, 42, 44, 46 in such an embodiment is similar to the orientation and positioning shown in FIG. 5*a* showing an exemplary embodiment without openings 35, 36, 37, 38. In the embodiment shown in FIG. 6*a*, the first carriage strap 40 extends between the first opening 35 and the third opening 37 of the carriage 30. The second carriage strap 42 extends between the second opening 36 and the fourth opening 38 of the carriage 30. The third carriage strap 44 extends between the first opening 35 and the second opening 36 of the carriage 30. The fourth carriage strap 46 extends between the third opening 37 and the fourth opening 38 of the carriage 30. Thus, the carriage straps 40, 42, 44, 46 in such an embodiment form a square-shaped outline across the carriage 30 body.

Figure 6B:
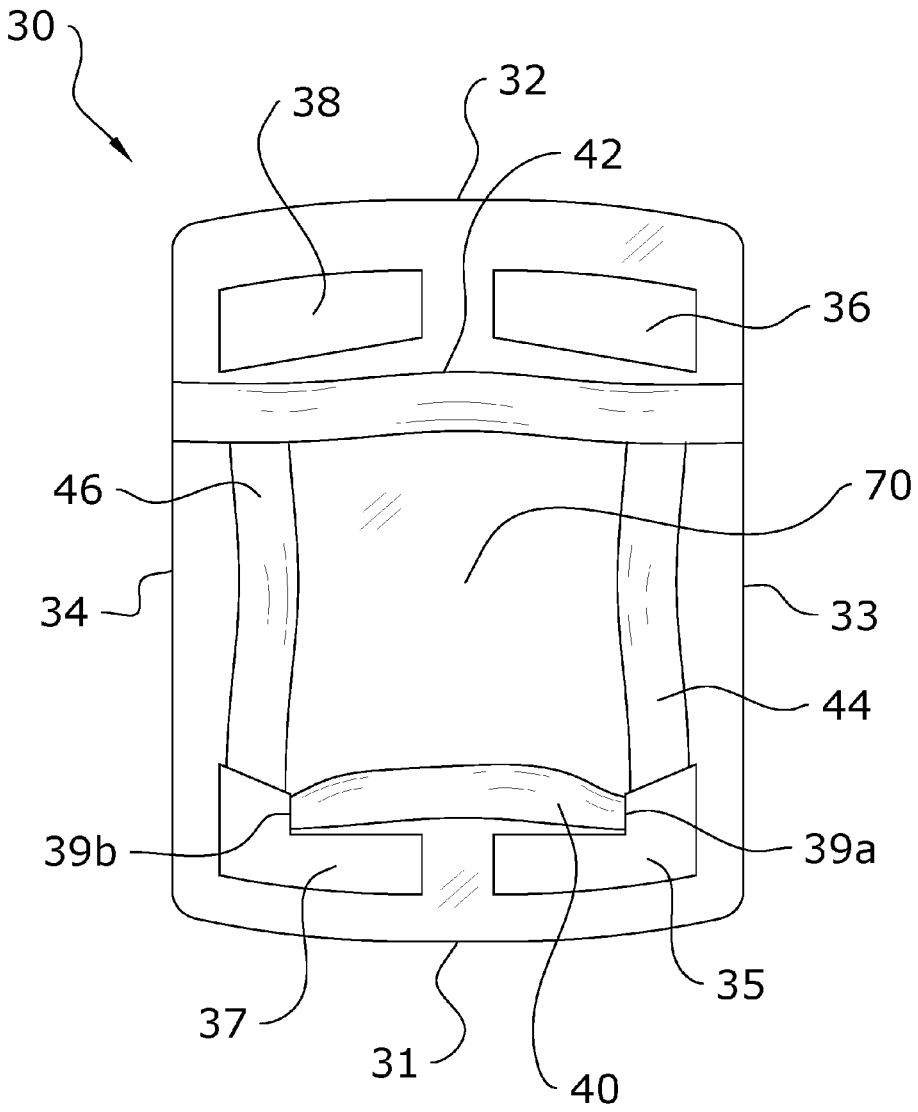
FIG. 6*b* is a top view of the carriage having openings and straps with the straps attached to the upper surface of the carriage.
Figure 6C:
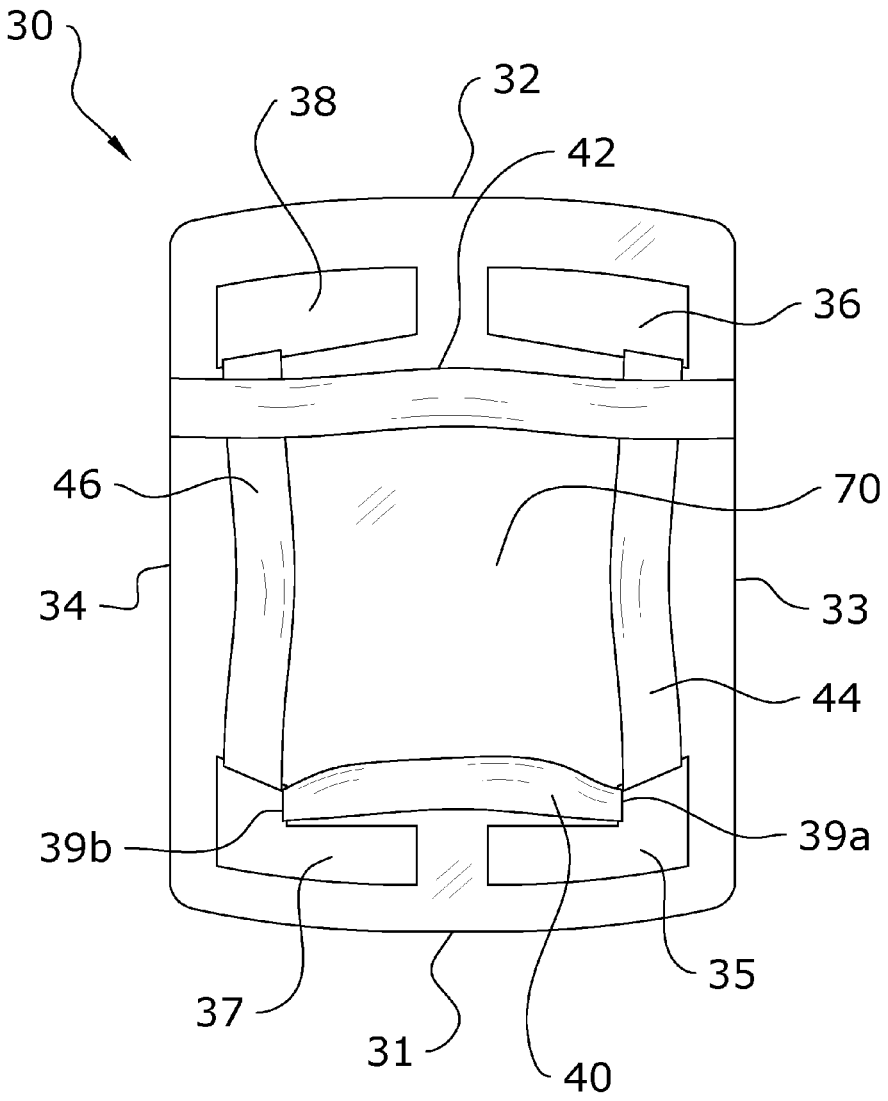
FIG. 6*c* is a top view of the carriage having openings and straps with the straps extending through the openings for attachment to the sides of the openings or the lower surface of the carriage.
Figure 6D:
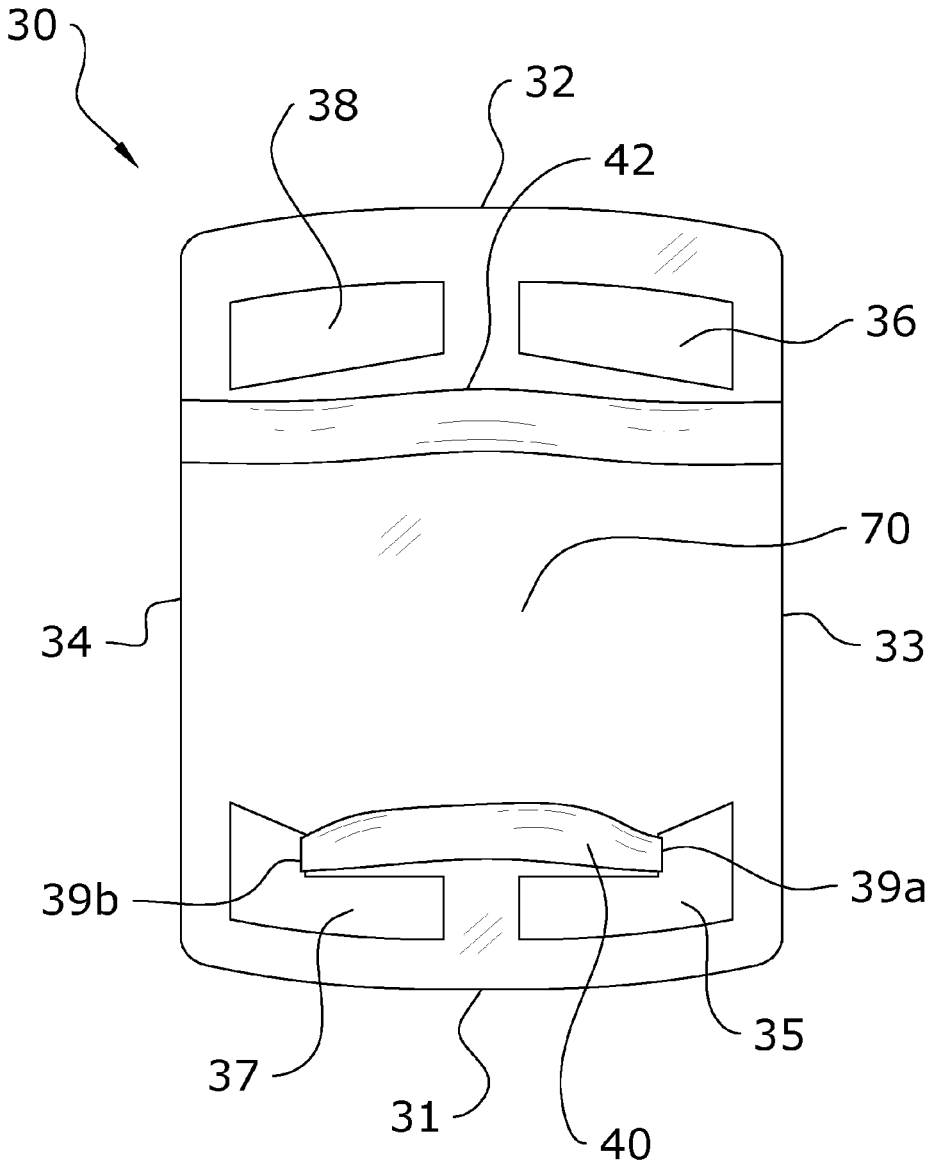
FIG. 6*d* is a top view of the carriage with openings and straps at opposing ends of the carriage.
Figure 6E:
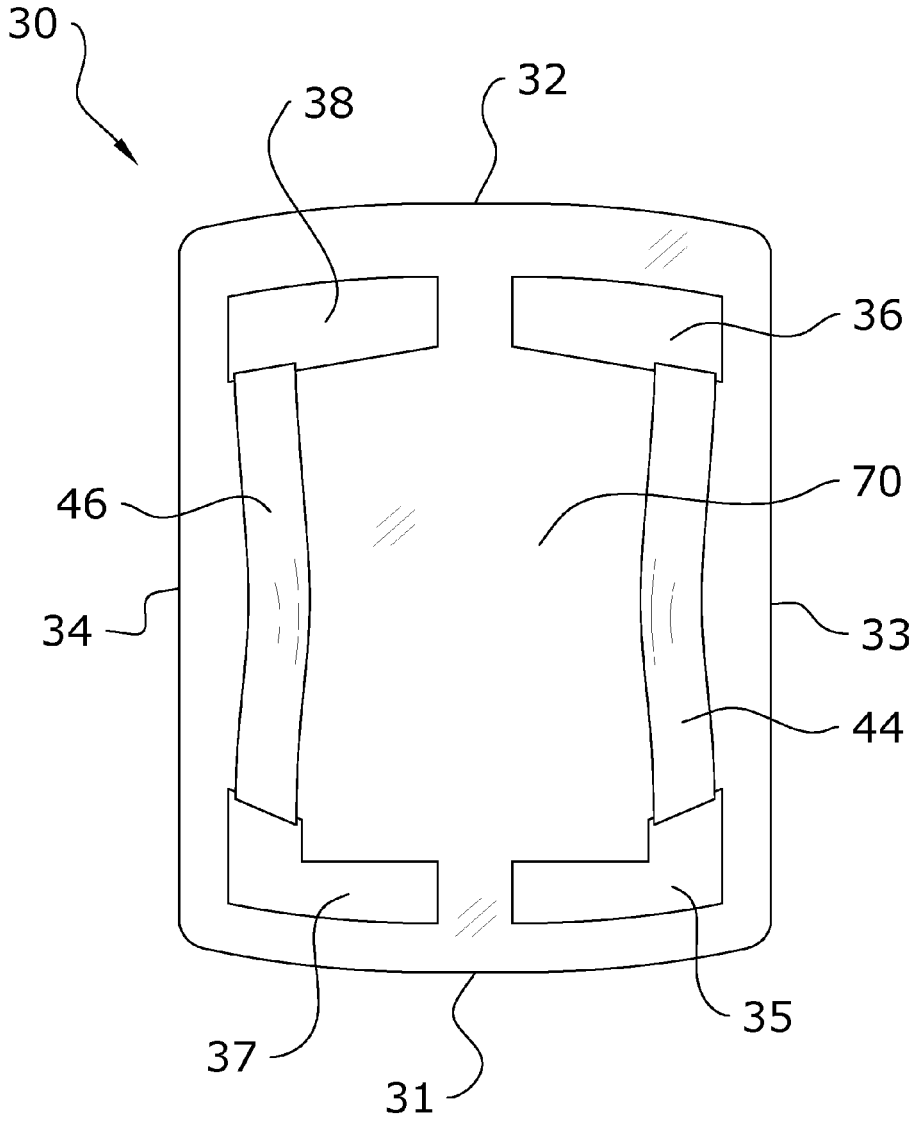
FIG. 6*e* is a top view of the carriage with openings and straps at opposing sides of the carriage.
Figure 6F:
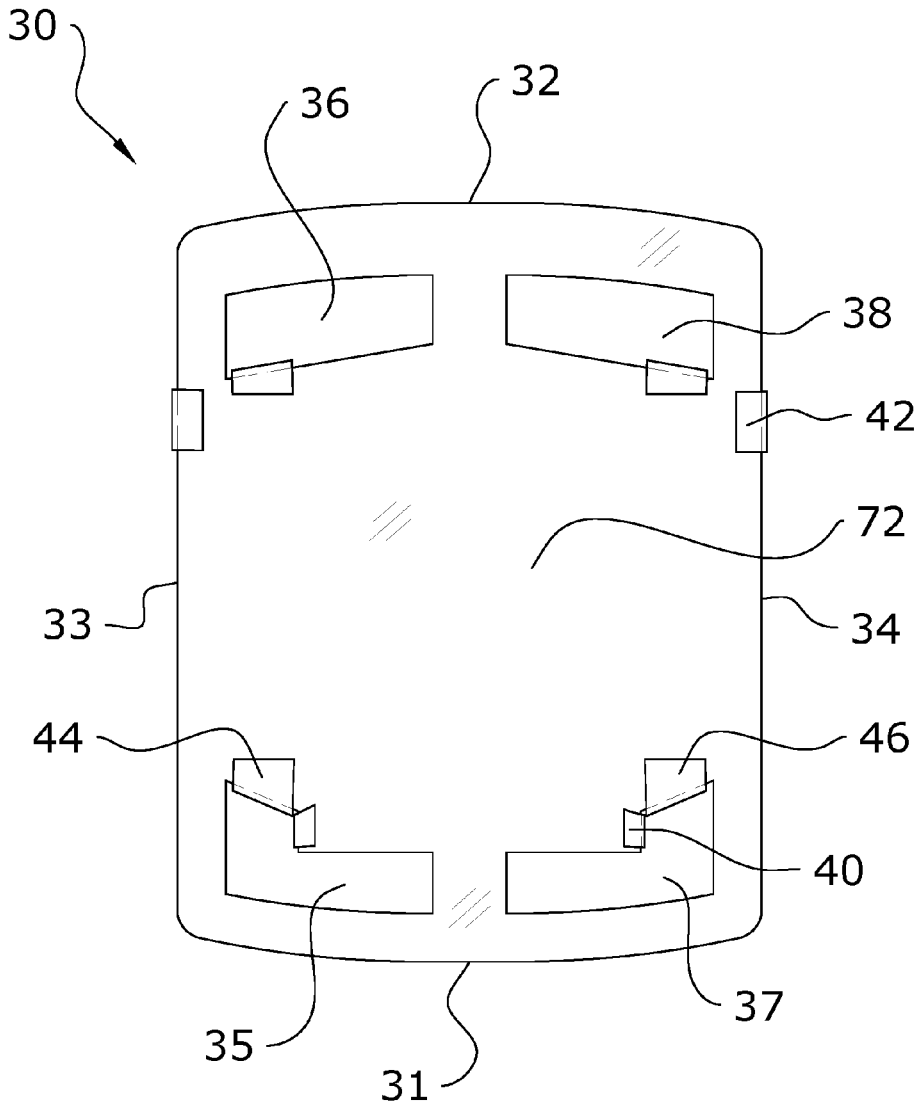
FIG. 6*f* is a bottom view of the carriage with the openings and straps extending through the openings attached to the lower surface of the carriage.
Figure 6G:
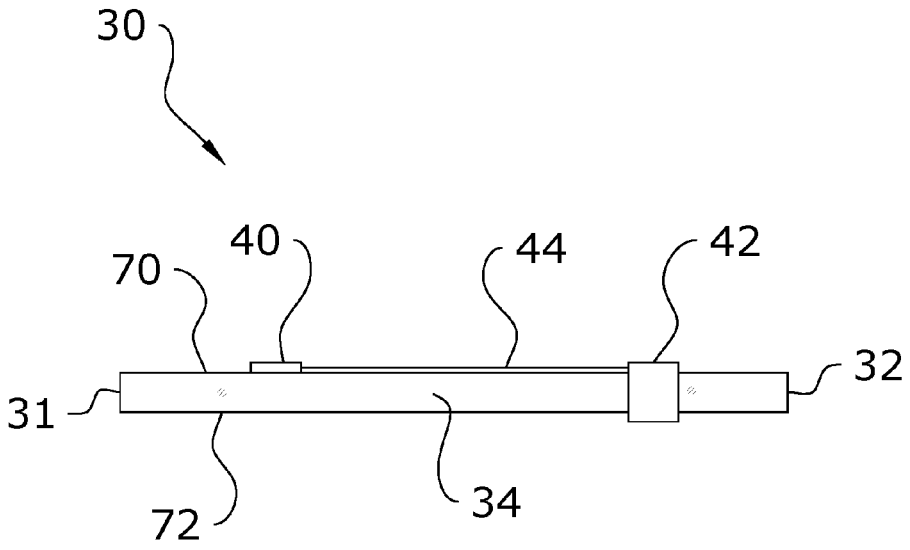
FIG. 6*g* is a side view of the carriage with the straps extending.

The carriage straps 40, 42, 44, 46 extend across at least a portion of the upper surface 70 of the carriage 30. One or more of the carriage straps 40, 42, 44, 46 may extend across the entire upper surface 70 of the carriage 30. The first carriage strap 40 is preferably closer to the first end 31 of the carriage 30 than the second carriage strap 42. The second carriage strap 42 is preferably closer to the second end 32 of the carriage 30 than the first carriage strap 40. The first and second carriage straps 40, 42 preferably transversely extend across a portion of the upper surface 70 of the carriage. The third carriage strap 44 and the fourth carriage strap 46 are each positioned closer to an opposite side 33, 34 of the carriage 30 as illustrated in FIG. 6*b* of the drawings. The third and fourth carriage straps 44, 46 extend longitudinally along the carriage 30 and further preferably are parallel with respect to the tracks 25, 26.

E. Platforms

As shown in FIGS. 1-3 and 7-12, the exercise machine 20 may include at least one platform 50, 60 connected to either end 23, 24 of the frame 22. In a preferred embodiment shown in the figures, a first platform 50 is included at the first end 23 of the frame 22 and a second platform 60 is included at the second end 24 of the frame 22. Each of the platforms 50, 60 comprise fixable structures between which the carriage 30 may be moved when the present invention is in use.

As shown in the figures, the first platform 50 includes a first end 51, a second end 52, a first side 53, and a second side 54. The second platform 60 similarly includes a first end 61, a second end 62, a first side 63, and a second side 64. The shape, size, numbering, configuration, and orientation of the platforms 50, 60 may vary and should not be construed as limited by the exemplary figures.

The platforms 50, 60 are shown as each having grips 55, 56, 65, 66 comprising handles extending therefrom. The first platform 50 is shown as having a first grip 55 on its first side 53 and a second grip 56 on its second side 54. The second platform 60 is also shown as having a first grip 65 on its first side 63 and a second grip 66 on its second side 64.

Although grips 55, 56, 65, 66 are shown affixed to the opposed platforms 50, 60, they are merely presented to illustrate the fact that one or more hand- or feet-holding features may be affixed to the stationary structure of the platforms 50, 60 for use during an exercise, either as a means of helping the exerciser 12 to maintain balance, or as a means to maintain a better balance or body positioning during exercise. The use or omission of such grips 55, 56, 65, 66 are entirely optional.

As best shown in FIG. 1, the first platform 50 may include a first platform strap 57 and the second platform 60 may include a second platform strap 67. The first platform strap 57 extends perpendicularly across the first platform 50 with respect to the tracks 25, 26. The second platform strap 67 similarly extends perpendicularly across the second platform 60 with respect to the tracks 25, 26.

The shape, size, configuration, numbering, orientation, and placement of the platform straps 57, 67 may vary in different embodiments. Preferably, the platform straps 57, 67 are flexible and not overly taught, thereby allowing a exerciser 12 to insert one or more feet or hands between one or more of the platform straps 57, 67 and the corresponding platform 50, 60 surface. By inserting feet or hands underneath the platform straps 57, 67 until all slack is removed and a solid mechanical engagement is realized, the exerciser 12 can more efficiently slide the carriage 30 along the parallel rails against the spring 27 resistance force, while at the same time, anchor their feet or hands to the platform(s) 50, 60 for better balance and safer performance of the exercise.

F. Operation of Preferred Embodiment

The terms "body", "foot", "ankle" and "hand" as used herein are not meant to be limiting, and refer to various parts of the human body that may be used to engage a Pilates apparatus to aid in overcoming a force during an exercise.

Further, although a small sampling of representative exercises are shown in the drawings, they are merely presented to illustrate the connection between positioning of the body upon an exercise machine 20 set at various points, as well as new methods of engagement between the exerciser 12 and the apparatus during exercising. Illustrating the body to apparatus engagement of hundreds of new and different exercises previously not possible to perform safely, or to perform at all on the present invention, would be unduly burdensome, but doing so would nevertheless affirm the novelty of the present invention, as well as the unanticipated benefits already described herein. It must also be realized, and would be instantly obvious to one skilled in the art, that the types of conditioning or therapeutic rehabilitation exercises that can be performed upon the present invention could be performed against much higher spring resistance force, and more safely than previously possible.

Figure 7:
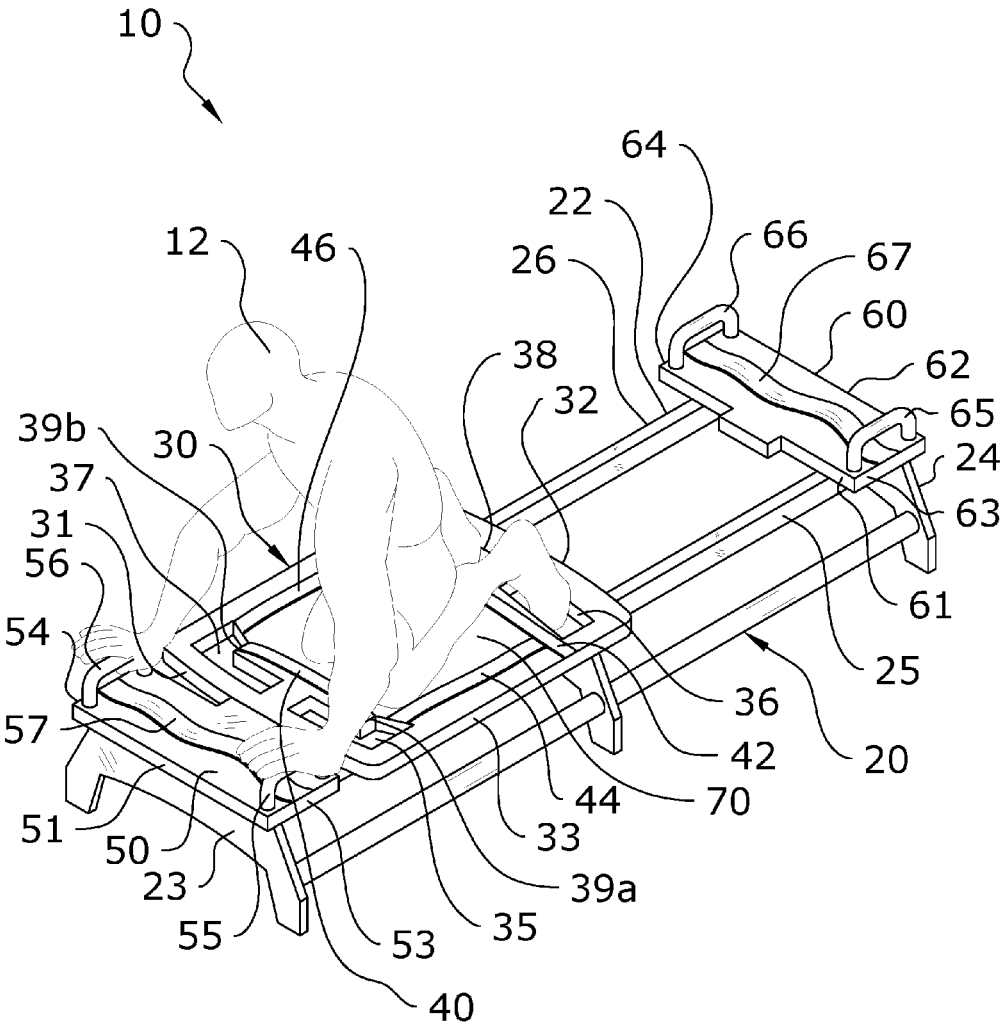
FIG. 7 is an upper perspective view of an exerciser in a retracted position performing a kneeling exercise with the present invention.
Figure 8:
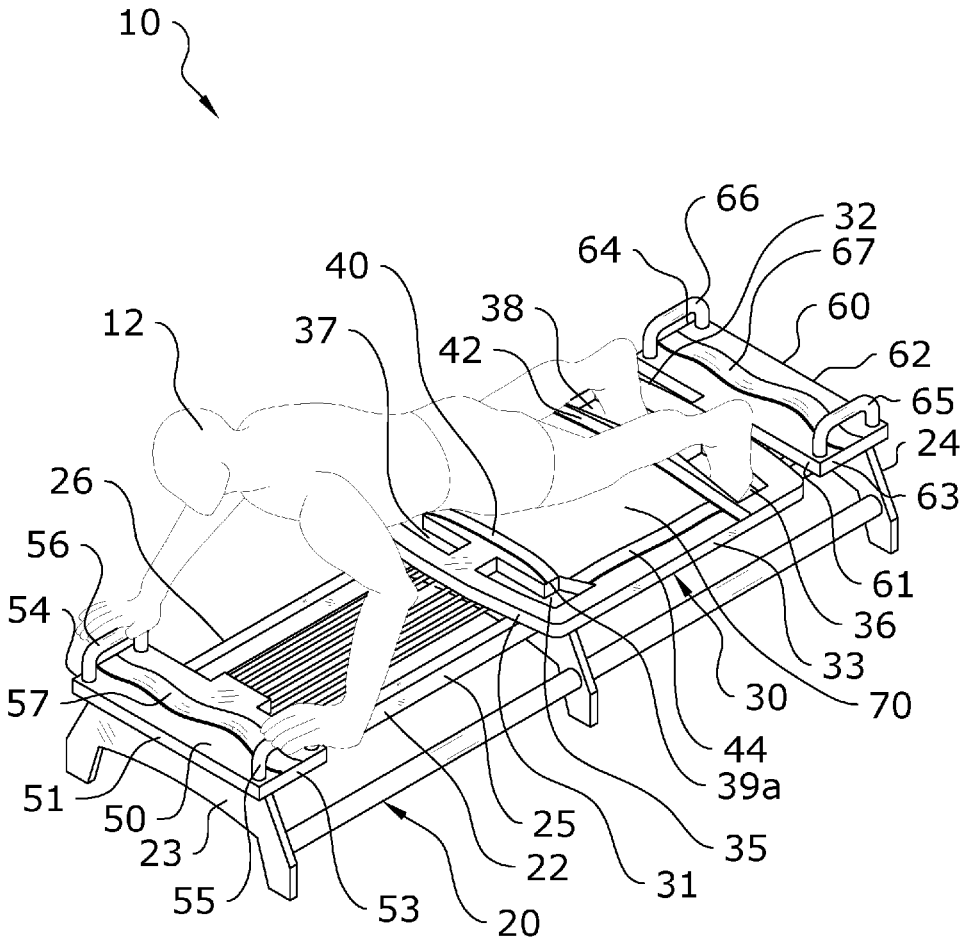
FIG. 8 is an upper perspective view of an exerciser in an extended position performing a kneeling exercise with the present invention.

FIGS. 7 and 8 illustrate an exemplary first exercise for use with the present invention, showing a side view of a representative exerciser 12 with their feet penetrating through openings 35, 36, 37, 38 on a carriage 30 while performing an exercise. To support the upper body, the exerciser's 12 hands are shown grasping stationary grips 55, 56 affixed to the first platform 50. Alternatively, the exerciser 12 can place their hands anywhere on or about the stationary first platform 50, and may anchor their hands using the first platform strap 57 located upon and affixed to the first platform 50.

To prepare to perform the exercise of the illustration, the exerciser 12 kneels upon the slidable carriage 30, inserting their feet through openings 35, 36, 37, 38 in the carriage 30, thus lowering the lower leg to the carriage 30 surface, while at the same time, reducing pressure on the toes, phalanges and connective tissue if the feet otherwise were limited to resting upon the upper surface of the carriage 30. The exerciser 12 has placed their hands on the grips 55, 56 provided, although the exerciser 12 could alternatively grasp any stationary portion of the present invention.

The carriage 30 rests upon, and is slidable along tracks 25, 26 that substantially extend the length of the frame 22. One or more springs bias members 27 are connected between the slidable carriage 30 and the frame 22. The bias members 27 create a resistance force, expressed herein as "R", against which an exerciser 12 must exert a work force, expressed herein as "F", to overcome during exercise. Stronger exercisers 12 may attach a plurality of high tension springs 27 to create a very high resistance force, while smaller or weaker exercisers 12 may attach only one low resistance spring 27. It is obvious to those skilled in the art that as more springs 27 are attached between the carriage 30 and frame 20, the resulting K force is increased, requiring the exerciser 12 to expend increased energy to move the carriage 30 against the increased work load.

The exerciser 12 starts in a kneeling position upon the carriage 30, with their knees proximal to the stationary first platform 50, and grasps the grips 55, 56. At this position, the springs 27 exert minimal force upon the carriage 30. As the exerciser 12 begins the exercise, they move their knees away from their hands, thereby causing the carriage 30 to move distal to the first platform 50, correspondingly stretching the spring 27 resistance means. As the springs 27 are extended, the K value of the resistance R increases, requiring the exerciser 12 to exert more exercise force F in order to overcome the increasing resistance. In instances where exercisers 12 want a very high intensity exercise routine either to shorten the duration of their routine, or to more aggressively engage large gluteal or lower back muscles, they may attach many springs 27 between the carriage 30 and stationary frame 22, thereby establishing a very high workout resistance.

FIG. 7 shows the exerciser 12 positioning one foot partially into an opening 35, 36, 37, 38 of the carriage 30. It should be noted that an exerciser 12 could place both feet into one or more of the openings 35, 36, 37, 38 to perform certain exercises, while only placing one foot in one of the openings 35, 36, 37, 38 for other exercises. In some instances, certain exercises performed on the present invention require only the foot, and not the exerciser's 12 lower leg to be in contact with the carriage 30 or platforms 50, 60.

Nevertheless, those exercises are often performed more efficiently when the exerciser's 12 foot engages a hard surface normal to the resistance force R, such as the inside wall of one of the openings 35, 36, 37, 38 in a carriage 30 that can be pushed directly opposite the direction of the spring 27 resistance force, rather than relying on the exerciser's 12 body weight and coefficient of friction between a small portion of the foot placed upon the top flat surface of a carriage 30 as with the prior art.

When the F force required to overcome the resistance force R is sufficiently high such that the contact between the exerciser's 12 knees and carriage 30 overcomes the coefficient of friction there between, the exerciser's 12 knees will slide along the carriage 30 without the benefit of moving the carriage 30 against the full resistance force. In such cases, the exerciser 12 loses the intended high intensity of the workout. The relatively low coefficient of friction between a person's body and the platforms 50, 60 of an exercise machine 20 is worsened when the exerciser 12 wears athletic clothes comprised of spandex or other slippery material, and when the exerciser 12 perspires on the top surface of the platform. In combination, the slippery material and wet platform 50, 60 surfaces create an environment that inhibits a high frictional coefficient, and at the same time, increases the potential for dangerous slips or falls from the apparatus.

On the other hand, by inserting their feet through one or more of the openings 35, 36, 37, 38 on the carriage 30, the exerciser 12 is able to push linearly and in direct opposition to the spring 27 resistance, obviating any requirement to maintain a frictional interference between their knees and surface of the carriage 30.

The novel introduction of one or more openings 35, 36, 37, 38 into an exercise machine 20 is important not only to prevent frictional slippage of the knees upon the carriage 30, but to also reduce or eliminate the possibility of injuring the toes and phalanges of the feet if otherwise requiring the toes to rest in a hyper-extended position upon the upper surface 70 of the carriage 30 or platforms 50, 60. Such a position not only positions the toes at or beyond the normal range of motion, it is potentially injury-causing, and uncomfortably distracting. Further, the lack of openings 35, 36, 37, 38 fails to provide the necessary mechanically sound connection between the exerciser 12 and the carriage 30 as is obviously required when performing exercises in situations when the very high R resistance of the springs 27 exceeds the coefficient of friction between the exerciser's 12 knees and carriage 30.

Figure 9:
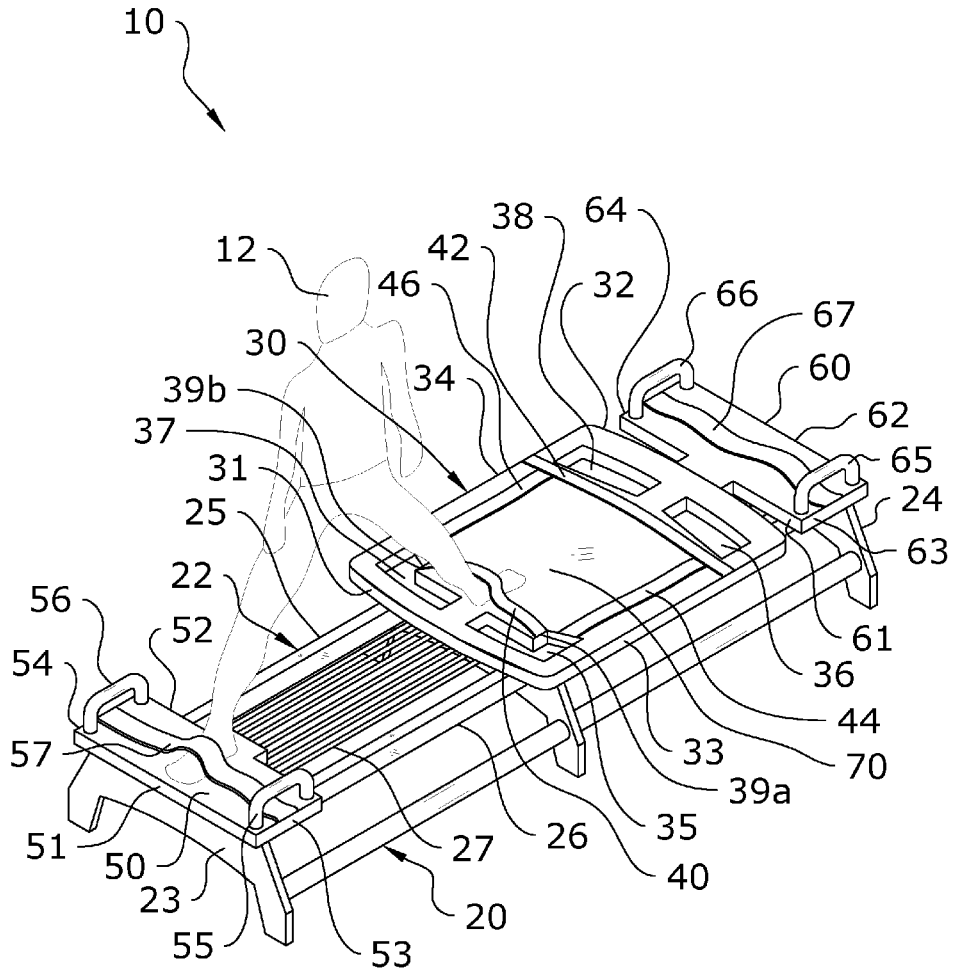
FIG. 9 is an upper perspective view of an exerciser in a retracted position performing a standing exercise with the present invention.
Figure 10:
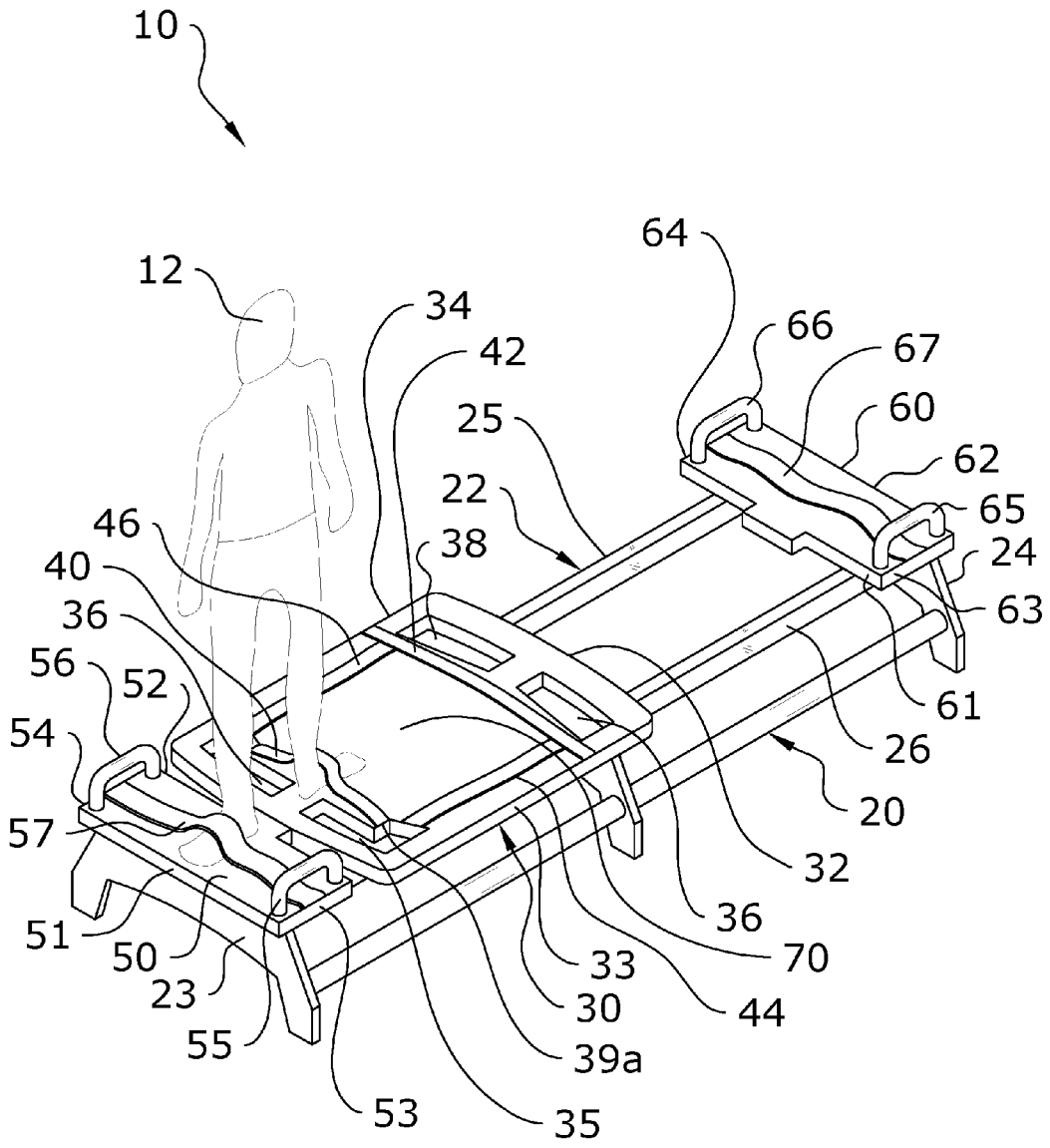
FIG. 10 is an upper perspective view of an exerciser in an extended position performing a standing exercise with the present invention.

FIGS. 9 and 10 are exemplary diagrams showing substantially a view of an exerciser 12 with their lower legs positioned upon the present invention, with one foot engaging the first platform strap 57 of the first platform 50, and a second foot engaging one of the carriage straps 40, 42, 44, 46 affixed to a slidable carriage 30 for the purposes of performing an exercise in which the exercise force F is applied in opposition to the spring 27 resistance force R.

More specifically, an exerciser 12 starts the exercise routine when the carriage 30 is at its resting position proximal to the stationary first platform 50. The exerciser 12 places their toes under one or more of the carriage straps 40, 42, 44, 46 and the first platform strap 57, and continues inserting each foot until the respective strap is taught, and rests against the instep, ankle or lower leg. When the straps 40, 42, 44, 46, 57 are taught, the feet are securely retained in the proper position to perform the exercise.

The exerciser 12 begins the work phase of the exercise by spreading their legs apart as shown in FIG. 8; the exercise force applied F being sufficient to overcome the spring 27 resistive force R, causing the slidable carriage 30 to move away from the stationary end platform 50. This phase is expressed mathematically as F>R. The exercise is continued until the feet are at a maximum distance from each other as determined to be within the exerciser's 12 normal range of motion, or a point at which the force of the extension springs 27 equals the exercise force applied to the carriage 30, simply expressed mathematically as R=F. Continuing the exercise, the exerciser 12 begins moving the feet towards one another slowly, resisting but not exceeding the spring 27 resistance force, expressed mathematically as R>F.

As will become obvious to those skilled in the art, the amount of work force applied against the spring 27 resistance force when the feet are secured to the platforms 50, 60 by platform straps 57, 67 is appreciably higher compared to relying merely on the coefficient of friction between the bottom surface of the foot, and the top surface of the platforms 50, 60 to prevent the feet from slipping from their starting positions.

Figure 11:
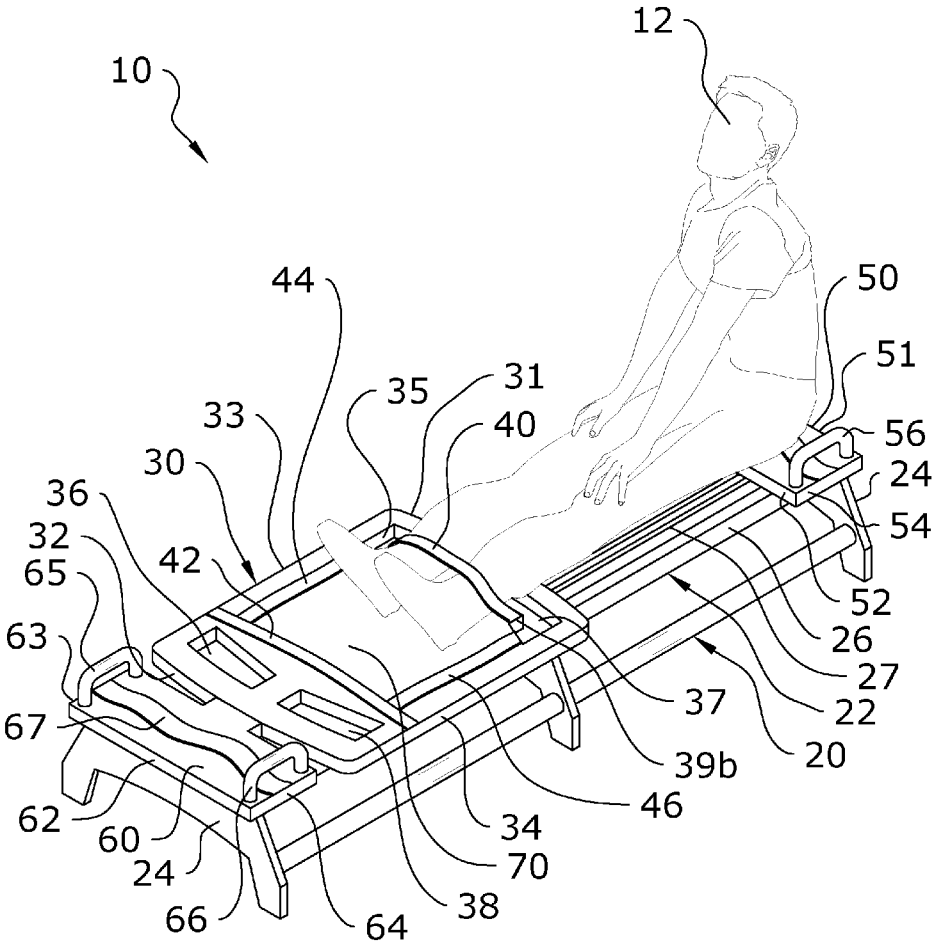
FIG. 11 is an upper perspective view of an exerciser in a retracted position performing a sitting exercise with the present invention.
Figure 12:
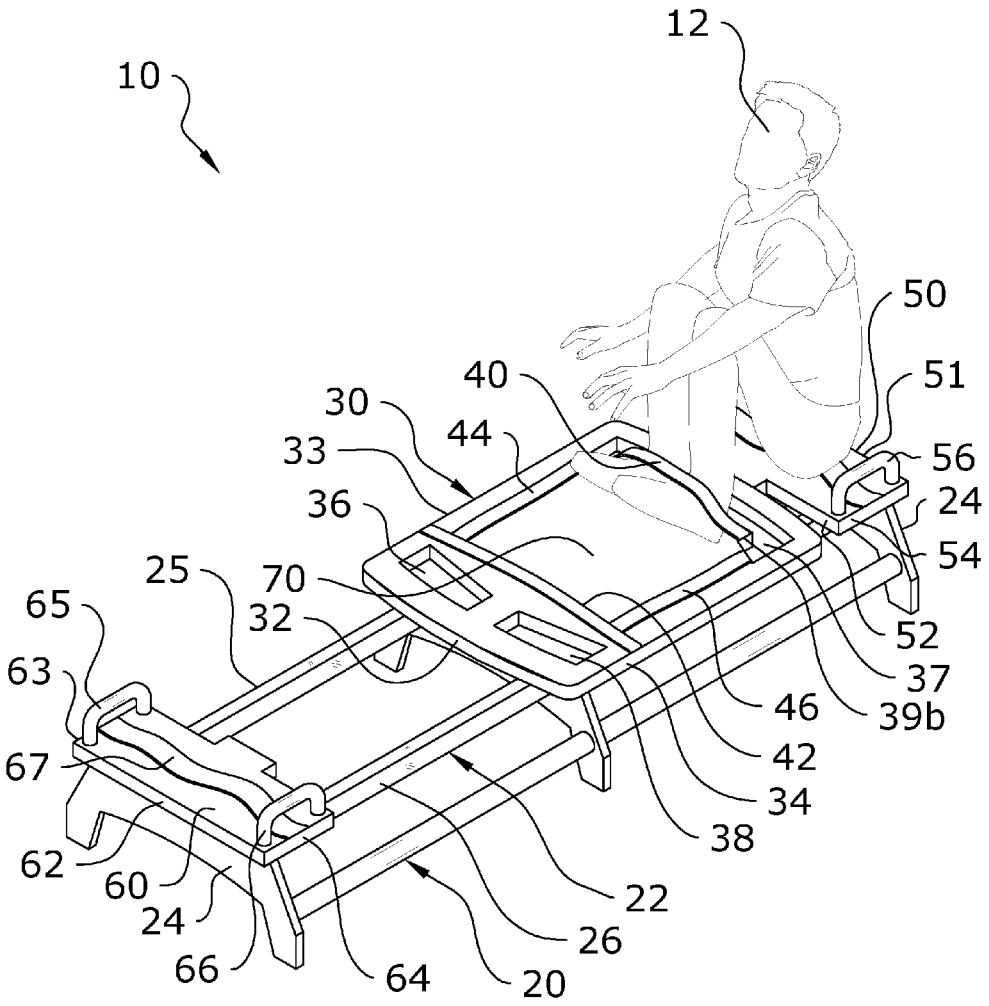
FIG. 12 is an upper perspective view of an exerciser in an extended position performing a sitting exercise with the present invention.

FIGS. 10 and 11 are exemplary diagrams showing substantially a view of an exerciser 12 positioned in a sitting position performing an abdominal exercise upon a stationary second platform 60, with their feet engaging one of the flexible carriage straps 35, 36, 37, 38, the ends of which are affixed to the slidable carriage 30 of the exercise machine 20.

To perform the exercise, the exerciser 12 begins by sitting on the stationary second platform 60, and with knees bent, placing their feet under one of the flexible carriage straps 40, 42, 44, 46 while the carriage 30 is proximal to the second platform 60. The heels of the feet may also engage the inner wall of one or more of the openings 35, 36, 37, 38 for added engagement of the carriage 30.

As the exercise begins, the exerciser 12 pushes their feet against one or more of the carriage straps 40, 42, 44, 46 and/or one or more of the openings 35, 36, 37, 38 such that the pushing force F exceeds the resistance force R of the springs 27. The exerciser 12 has cantilevered the weight of their torso beyond the stationary platform 60, thereby inducing a lifting force that acts upwardly on the feet. Without the feet being secured to the carriage 30 by one or more of the carriage straps 40, 42, 44, 46, the feet would lift from the carriage 30, thereby reducing or eliminating the workload upon the abdominal muscles.

Further, since the downward force of the feet upon the carriage 30 is nominal, or even negative, meaning the feet are lifting from the carriage 30 surface, there can be no reliance on friction between the feet and carriage 30 to reasonably push the carriage 30 against the spring 27 resistance force. Therefore, the straps 40, 42, 44, 46 prevent the feet from lifting from the carriage 30 during an exercise, and the strap 40, 42, 44, 46 and/or one or more of the openings 35, 36, 37, 38 separately or together provide for a solid mechanical surface normal to R against which the exerciser 12 may apply foot force sufficient enough to overcome R.

As will become immediately obvious to one skilled in the art, the use of straps 40, 42, 44, 46, 57, 67 and/or carriage openings 35, 36, 37, 38 as just described allow an exerciser 12 to perform this exercise upon the present invention, but absent one or more of the straps 40, 42, 44, 46, 57, 67 and/or one or more of the openings 35, 36, 37, 38, it would be nearly impossible for the exerciser 12 to perform this exercise, such as on a prior art device. Therefore, the present invention not only secures feet and hands more soundly to the surfaces of an exercise machine 20, they reduce the risk of injury caused by slipping on the carriage 30 or platforms 50, 60, and further allows the performance of certain exercises that could not be performed previously on prior art devices without straps 40, 42, 44, 46, 57, 67 and/or openings 35, 36, 37, 38.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An exercise machine, comprising:

a frame having at least one track, a first end and a second end opposite the first end, wherein the frame includes a central longitudinal axis and wherein the frame has a longitudinal axis;

a carriage movably connected to the at least one track, the carriage including a first end and a second end opposite of the first end;

wherein the carriage is adapted to be movable along a portion of the longitudinal axis;

at least one spring connected to the carriage, wherein the at least one spring provides a resistance force to the carriage;

a first platform connected to or near the first end of the frame, wherein the first platform has an upper surface;

a first stationary handle extending upwardly from the upper surface of the first platform, wherein the first stationary handle extends upwardly from near a first side of the first platform, wherein the first stationary handle comprises a loop structure;

a second stationary handle extending upwardly from the upper surface of the first platform, wherein the second stationary handle extends upwardly from near a second side of the first platform, wherein the second stationary handle comprises a loop structure;

wherein the first stationary handle extends between a first end of the first platform and a second end of the first platform, wherein the second stationary handle extends between the first end of the first platform and the second end of the first platform;

a second platform connected to or near the second end of the frame, wherein the second platform has an upper surface;

a third stationary handle extending upwardly from the upper surface of the second platform, wherein the third stationary handle extends upwardly from near a first side of the second platform, wherein the third stationary handle comprises a loop structure; and a fourth stationary handle extending upwardly from the upper surface of the second platform, wherein the second stationary handle extends upwardly from near a second side of the second platform, wherein the fourth stationary handle comprises a loop structure;

wherein the upper surfaces of the carriage, the first platform and the second platform are all on a common plane.

2. The exercise machine of claim 1, wherein the first stationary handle and the second stationary handle each have an inverted U-shaped structure.

3. The exercise machine of claim 2, wherein the third stationary handle and the fourth stationary handle each have an inverted U-shaped structure.

4. The exercise machine of claim 1, wherein the first stationary handle and the second stationary handle are parallel to one another.

5. The exercise machine of claim 4, wherein the third stationary handle and the fourth stationary handle are parallel to one another.

6. The exercise machine of claim 1, wherein the first stationary handle, second stationary handle, third stationary handle, and fourth stationary handle are each oriented parallel with respect to the at least one track.

7. The exercise machine of claim 1, wherein the third stationary handle extends between a first end of the second platform and a second end of the second platform, wherein the fourth stationary handle extends between the first end of the second platform and the second end of the second platform.

8. The exercise machine of claim 3, wherein an upper end of each of the first stationary handle, the second stationary handle, the third stationary handle, and the fourth stationary handle comprises a straight angled portion and a straight horizontal portion.

9. An exercise machine, comprising:

a frame having at least one track, a first end and a second end opposite the first end, wherein the frame includes a central longitudinal axis and wherein the frame has a longitudinal axis;

a carriage movably connected to the at least one track, the carriage including a first end and a second end opposite of the first end;

wherein the carriage is adapted to be movable along a portion of the longitudinal axis;

at least one spring connected to the carriage, wherein the at least one spring provides a resistance force to the carriage;

a first platform connected to or near the first end of the frame, wherein the first platform has an upper surface;

a first stationary handle extending upwardly from the upper surface of the first platform, wherein the first stationary handle extends upwardly from near a first side of the first platform, wherein the first stationary handle comprises an inverted U-shaped structure;

a second stationary handle extending upwardly from the upper surface of the first platform, wherein the second stationary handle extends upwardly from near a second side of the first platform, wherein the second stationary handle comprises an inverted U-shaped structure, wherein the first stationary handle is parallel with respect to the second stationary handle;

wherein the first stationary handle extends between a first end of the first platform and a second end of the first platform, wherein the second stationary handle extends between the first end of the first platform and the second end of the first platform;

a second platform connected to or near the second end of the frame, wherein the second platform has an upper surface;

a third stationary handle extending upwardly from the upper surface of the second platform, wherein the third stationary handle extends upwardly from near a first side of the second platform, wherein the third stationary handle comprises an inverted U-shaped structure; and a fourth stationary handle extending upwardly from the upper surface of the second platform, wherein the second stationary handle extends upwardly from near a second side of the second platform, wherein the fourth stationary handle comprises an inverted U-shaped structure, wherein the third stationary handle is parallel with respect to the fourth stationary handle.

10. The exercise machine of claim 9, wherein the upper surfaces of the carriage, the first platform and the second platform are all on a common plane.

11. The exercise machine of claim 9, wherein an upper end of each of the first stationary handle, the second stationary handle, the third stationary handle, and the fourth stationary handle comprises a straight angled portion and a straight horizontal portion.

12. The exercise machine of claim 9, wherein the first stationary handle, second stationary handle, third stationary handle, and fourth stationary handle are each oriented parallel with respect to the at least one track.

13. The exercise machine of claim 9, wherein the third stationary handle extends between a first end of the second platform and a second end of the second platform, wherein the fourth stationary handle extends between the first end of the second platform and the second end of the second platform.

14. An exercise machine, comprising:

a frame having at least one track, a first end and a second end opposite the first end, wherein the frame includes a central longitudinal axis and wherein the frame has a longitudinal axis;

a carriage movably connected to the at least one track, the carriage including a first end and a second end opposite of the first end;

wherein the carriage is adapted to be movable along a portion of the longitudinal axis;

at least one spring connected to the carriage, wherein the at least one spring provides a resistance force to the carriage;

a first platform connected to or near the first end of the frame, wherein the first platform has an upper surface, a first end, and a second end;

a first stationary handle extending upwardly from the upper surface of the first platform, wherein the first stationary handle extends upwardly from near a first side of the first platform, wherein the first stationary handle comprises an inverted U-shaped structure, wherein the first stationary handle extends between the first end and the second end of the first platform, wherein the first stationary handle is oriented parallel with respect to the at least one track;

a second stationary handle extending upwardly from the upper surface of the first platform, wherein the second stationary handle extends upwardly from near a second side of the first platform, wherein the second stationary handle comprises an inverted U-shaped structure, wherein the first stationary handle is parallel with respect to the second stationary handle, wherein the second stationary handle extends between the first end and the second end of the first platform, wherein the second stationary handle is oriented parallel with respect to the at least one track;

a second platform connected to or near the second end of the frame, wherein the second platform has an upper surface, a first end, and a second end;

a third stationary handle extending upwardly from the upper surface of the second platform, wherein the third stationary handle extends upwardly from near a first side of the second platform, wherein the third stationary handle comprises an inverted U-shaped structure, wherein the third stationary handle extends between the first end and the second end of the second platform, wherein the third stationary handle is oriented parallel with respect to the at least one track; and a fourth stationary handle extending upwardly from the upper surface of the second platform, wherein the second stationary handle extends upwardly from near a second side of the second platform, wherein the fourth stationary handle comprises an inverted U-shaped structure, wherein the third stationary handle is parallel with respect to the fourth stationary handle, wherein the fourth stationary handle extends between the first end and the second end of the second platform, wherein the fourth stationary handle is oriented parallel with respect to at least one track.

15. The exercise machine of claim 14, wherein the upper surfaces of the carriage, the first platform and the second platform are all on a common plane.

16. The exercise machine of claim 14, wherein an upper end of each of the first stationary handle, the second stationary handle, the third stationary handle, and the fourth stationary handle comprises a straight angled portion and a straight horizontal portion.

* * * * *